US006869292B2

(12) United States Patent
Johnescu et al.

(10) Patent No.: US 6,869,292 B2
(45) Date of Patent: Mar. 22, 2005

(54) MODULAR MEZZANINE CONNECTOR

(75) Inventors: Douglas Michael Johnescu, York, PA (US); Craig W. Clewell, Harrisburg, PA (US); Lewis R. Johnson, Liverpool, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 09/919,321

(22) Filed: Jul. 31, 2001

(65) Prior Publication Data

US 2003/0027439 A1 Feb. 6, 2003

(51) Int. Cl.[7] ..... H01R 12/00
(52) U.S. Cl. ..... 439/74; 439/83
(58) Field of Search ..... 439/74, 83, 70, 439/71, 68, 72

(56) References Cited

U.S. PATENT DOCUMENTS

| | | | | | |
|---|---|---|---|---|---|
| 4,045,105 | A | * | 8/1977 | Lee et al. | 439/69 |
| 5,098,311 | A | | 3/1992 | Roath et al. | 439/289 |
| 5,334,029 | A | | 8/1994 | Akkapeddi et al. | 439/66 |
| 5,387,139 | A | | 2/1995 | McKee et al. | 439/876 |
| 5,527,189 | A | | 6/1996 | Middlehurst et al. | 439/608 |
| 5,562,442 | A | * | 10/1996 | Wilhelm | 110/211 |
| 5,573,409 | A | | 11/1996 | Shiley et al. | 439/76.1 |
| 5,664,968 | A | | 9/1997 | Mickievicz | 439/608 |
| 5,730,606 | A | | 3/1998 | Sinclair | 439/70 |
| 5,782,656 | A | | 7/1998 | Zell et al. | 439/579 |
| 5,795,191 | A | | 8/1998 | Preputnick et al. | 439/608 |
| 5,904,594 | A | | 5/1999 | Longueville et al. | 439/608 |
| RE36,217 | E | | 6/1999 | Peterson | 324/755 |
| 6,024,584 | A | | 2/2000 | Lemke et al. | |
| 6,079,991 | A | | 6/2000 | Lemke et al. | 439/83 |
| 6,097,609 | A | * | 8/2000 | Kabadi | 174/253 |
| 6,146,208 | A | | 11/2000 | Pennell | 439/675 |
| 6,164,983 | A | * | 12/2000 | Lemke et al. | 439/78 |

FOREIGN PATENT DOCUMENTS

| | | |
|---|---|---|
| GB | 2 299 465 | 10/1996 |
| GB | 2 312 566 | 10/1997 |
| GB | 2 345 807 | 7/2000 |

* cited by examiner

*Primary Examiner*—P. Austin Bradley
*Assistant Examiner*—Edwin A. Leon
(74) *Attorney, Agent, or Firm*—Woodcock Washburn LLP

(57) ABSTRACT

A modular board to board mezzanine ball grid array BGA connector includes a plug, a receptacle and if needed an adapter. The plug and the receptacle can be made form the same base pieces to accommodate different stack heights. If a greater stack height is needed, spacers can be used in the plug and the receptacle to accommodates a greater selected stack height. The plug and the receptacle both include a base having an interstitial diamond recesses in which the solder balls are disposed and in which one end of a contact is inserted. The plug may further include a plug cover that can be connected to the base, and the receptacle may include a receptacle cover that fits over its base. The plug can have a plug contact assembly, and the receptacle can have a receptacle contact assembly. The plug and the receptacle can be mated by mating the plug cover to the receptacle cover and the receptacle contacts to the plug contacts. If a larger stack height is desired, a spacer can be attached to the base of either or both the plug or the receptacle to achieve a larger stack height.

42 Claims, 21 Drawing Sheets

32
18
16
45
67
20
14
55
55
61
59
53

Mezzanine Stripline

In-Line Stripline

MODULAR MEZZANINE CONNECTOR

FIELD OF THE INVENTION

This invention relates to a modular board to board mezzanine style connector.

BACKGROUND OF THE INVENTION

Ball grid array (BGA) connectors are generally known in the art and a general discussion of such connectors can be found in U.S. Pat. No. 5,730,606. In these types of connectors an integrated circuit is mounted to a plastic or ceramic substrate with a ball grid array, which generally includes spherical solder balls that are positioned on electrical contact pads of a circuit substrate. These types of connectors can be mounted to an integrated circuit without using external leads extending from the integrated circuit. Among the advantages of ball grid array connectors are smaller package sizes, good electrical performance and lower profiles.

In prior mezzanine style connectors unique components were required for each connector stack height and gender. This invention includes a modular mezzanine style board to board connector that can be made to a selected stack height by choosing from a variety of common components that can mixed or matched to provide a desired stack height. Regardless of the stack height, the plug and the receptacle can be made using at least some of the same components. If a larger stack height is needed, additional components can be added.

SUMMARY OF THE INVENTION

This invention includes a modular mezzanine connector that has a plug assembly and a receptacle assembly each of which have a common base. The plug assembly and the receptacle assembly can mate with each other to form a modular connector for connecting a variety of electrical components including printed circuit boards. Because the plug and the receptacle assemblies each have a common base, only one base needs to be mass produced in order to make both assemblies. This is advantageous because it simplifies manufacturing and reduces manufacturing costs.

The common base of the plug and receptacle assemblies may have a plurality of recesses and a plurality of diamond pockets disposed in an interstitial configuration. Preferably, there is a pocket beneath each recess so that a contact can extend through one of the recesses and into one of the pockets. The plurality of recesses are preferably substantially rectangular in shape so that a contact extending through the recess and into the diamond pocket can receive a fusible element, such as solder, around a periphery of a portion of the contact extending into the pocket.

The plug assembly may also include a plug cover and a plurality of plug contact assemblies. The plug cover may be attached to the base by any suitable means including snaps. The plug contact assemblies may each have a plurality of ground and signal contacts which are molded to a plastic carrier. In order to hold the plug contact assemblies in the plug assembly, the plastic carrier is inserted into slots within the base.

The plug cover may have a plurality of slots through which one end of each of the plug contacts of the plug contact assemblies extend. The other end of the plug contacts extends through the recess in the base into a pocket, and a solder ball is formed around the end of the contact in the pocket.

The receptacle assembly may also have a receptacle cover and a plurality of receptacle contact assemblies. Attached to the base may be the receptacle cover. Similar to the plug contact assemblies, the receptacle contact assemblies are preferably soldered at one end within a base pocket. Also similar to the plug contact assemblies, the receptacle contact assemblies preferably include a plurality of contacts which are molded to a plastic carrier. The plastic carrier can be inserted into the slots of the base.

The receptacle cover preferably has a plurality of slots with a receptacle contact disposed beneath each slot. The receptacle assembly and the plug assembly are coupled together by mating the receptacle cover and the plug cover. Preferably, they can be coupled with a sliding fit. When coupled together, a plug contact extends through each of the slots in the receptacle cover and mates with a corresponding receptacle contact.

Both the plug and the receptacle assemblies can employ a common spacer for greater stack heights. The spacer can be attached to the base of either assembly and the respective plug or receptacle cover can be attached to the spacer. Any suitable means can be used to attach the components including snaps.

Other features of the inventions are described below.

DETAILED DESCRIPTION OF PREFERRED EMBODIMENTS

Figures 1, 2:
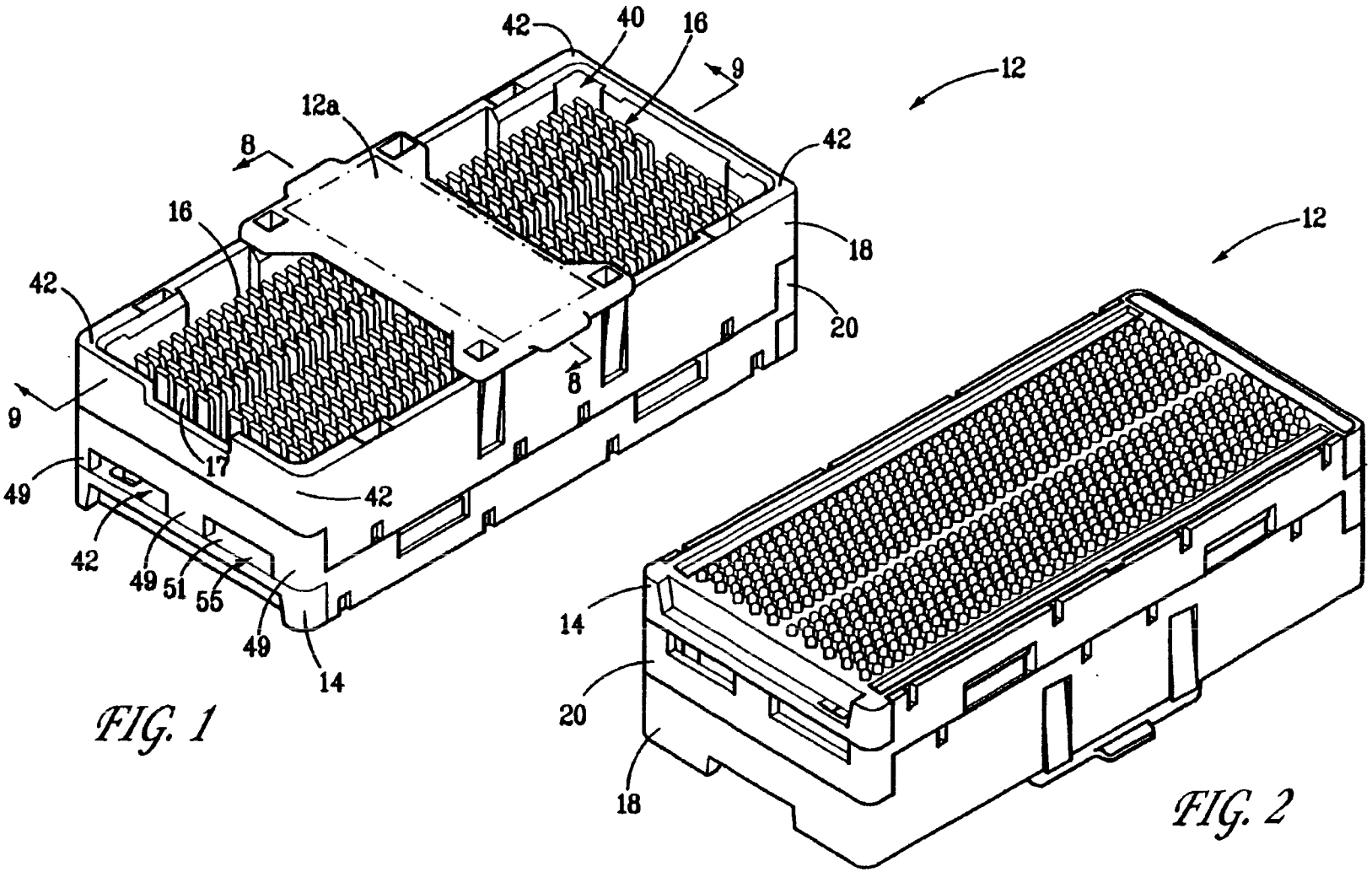
FIG. 1 is a top isometric view of a plug assembly according to a preferred embodiment of this invention.
FIG. 2 is a bottom isometric view of a plug assembly according to a preferred embodiment of this invention.
Figure 18:
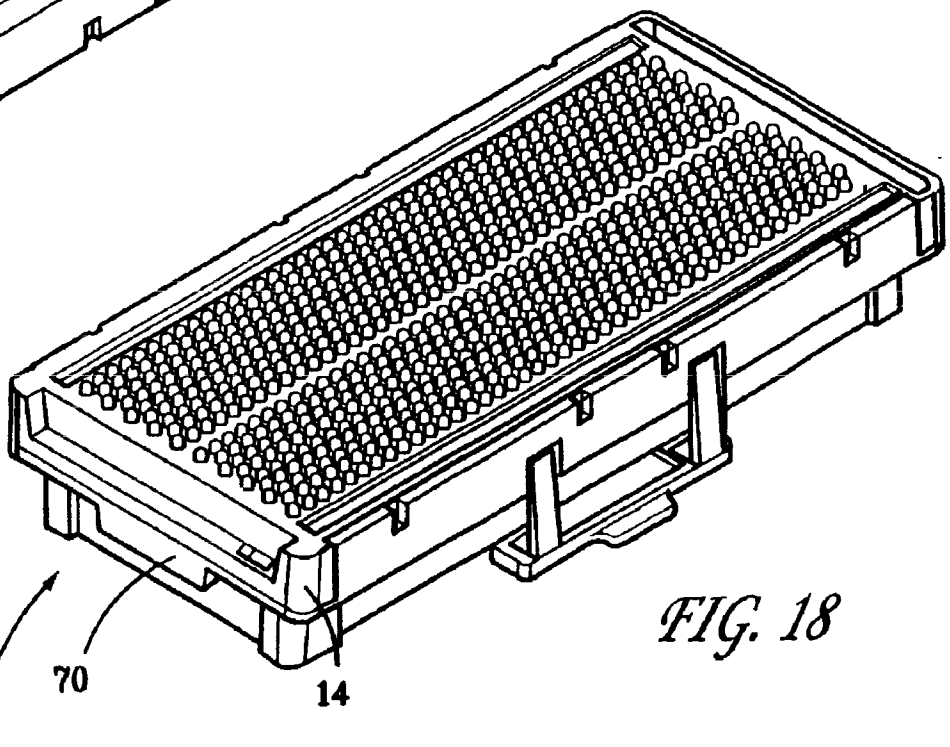
FIG. 18 is a bottom perspective view of a receptacle assembly according to a preferred embodiment of this invention.
Figure 17:
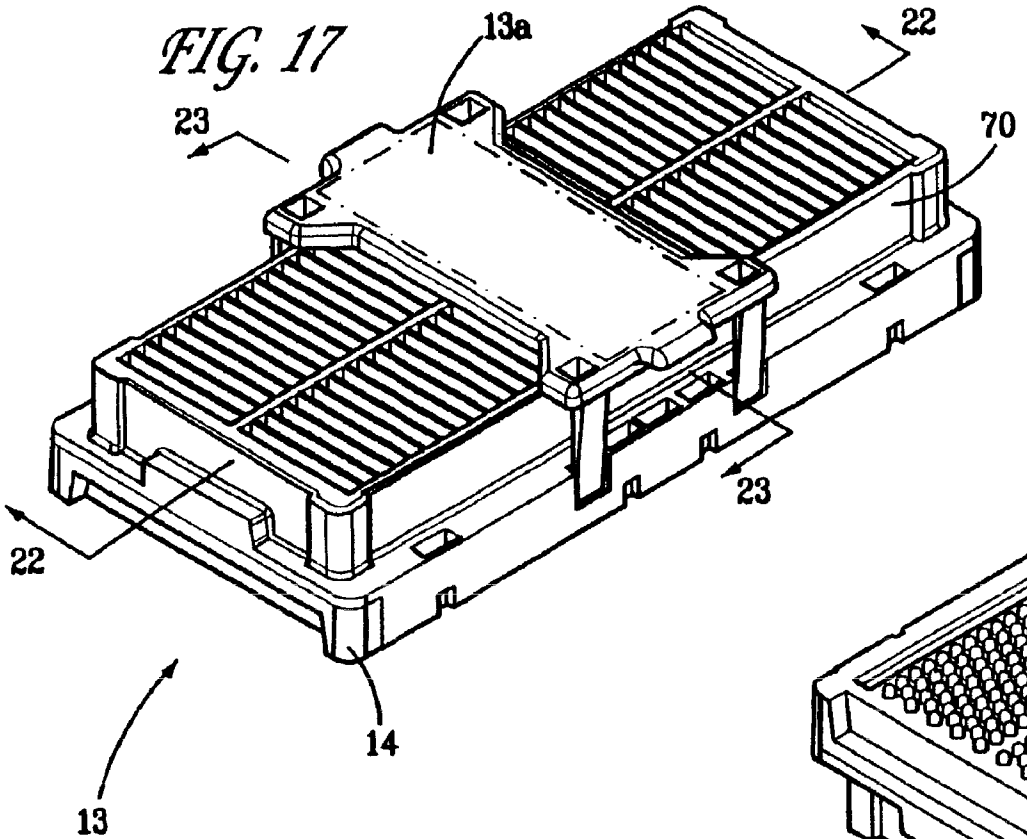
FIG. 17 is a top perspective view of a receptacle assembly according to a preferred embodiment of this invention.

The electrical connector may be a board to board mezzanine ball grid array (BGA) connector which includes a mated assembly having a plug assembly 12, a preferred embodiment of which is shown in FIGS. 1 and 2, and a receptacle assembly 13, a preferred embodiment of which is shown in FIGS. 17 and 18. The plug assembly 12 mates with the receptacle assembly 13 to form a connector. As described in more detail below, the plug assembly 12 and the receptacle assembly 13 have a common base 14. Thus, the manufacturing of the plug assembly 12 and the receptacle assembly 13 is simplified because the plug assembly 12 and the receptacle assembly 13 can be made from a common base 14. This is also beneficial because it reduces manufacturing costs.

Plug Assembly

Figure 3:
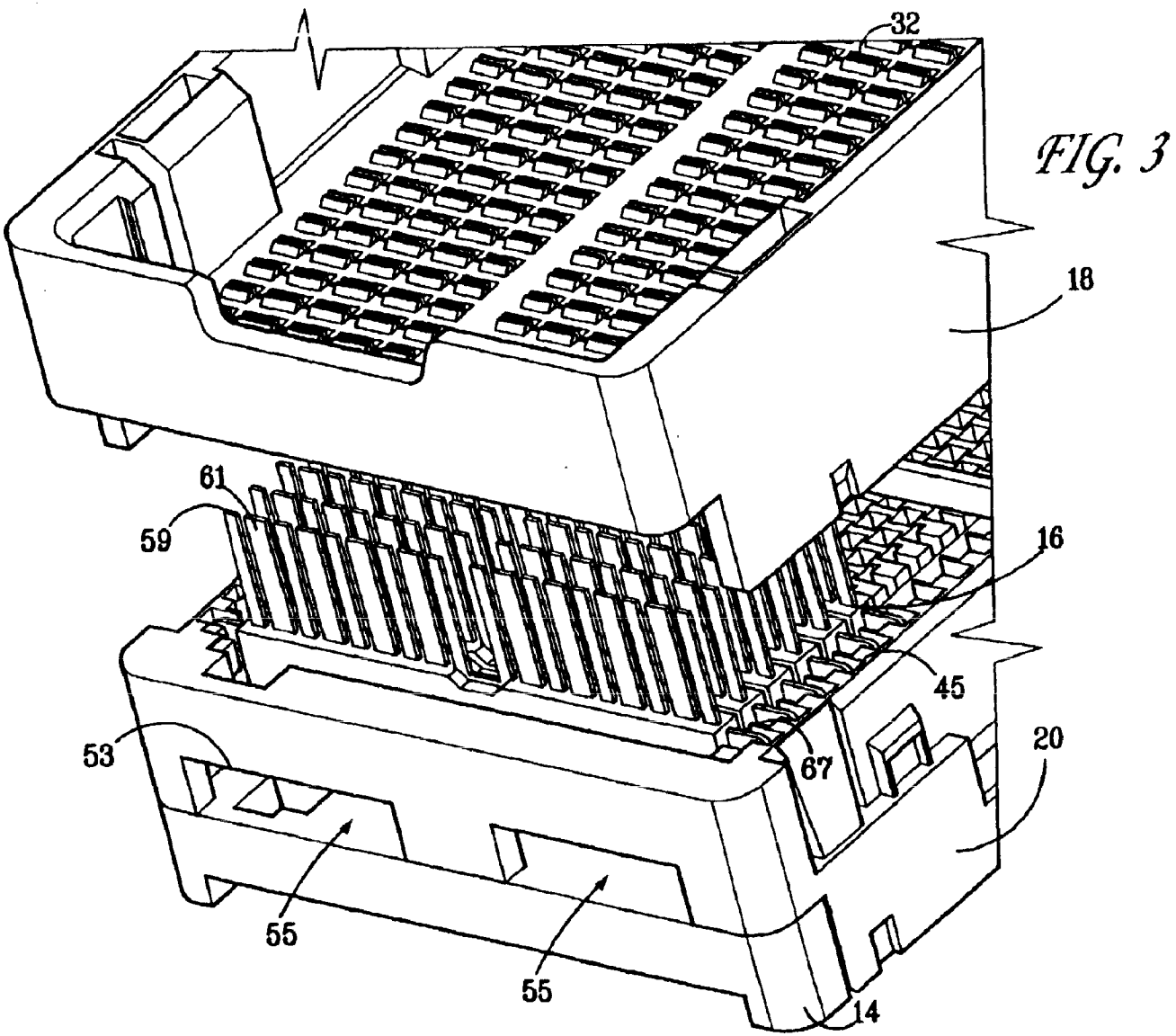
FIG. 3 is an assembly drawing of the plug assembly of FIG. 1 with the plug cover removed.
Figures 14, 15:
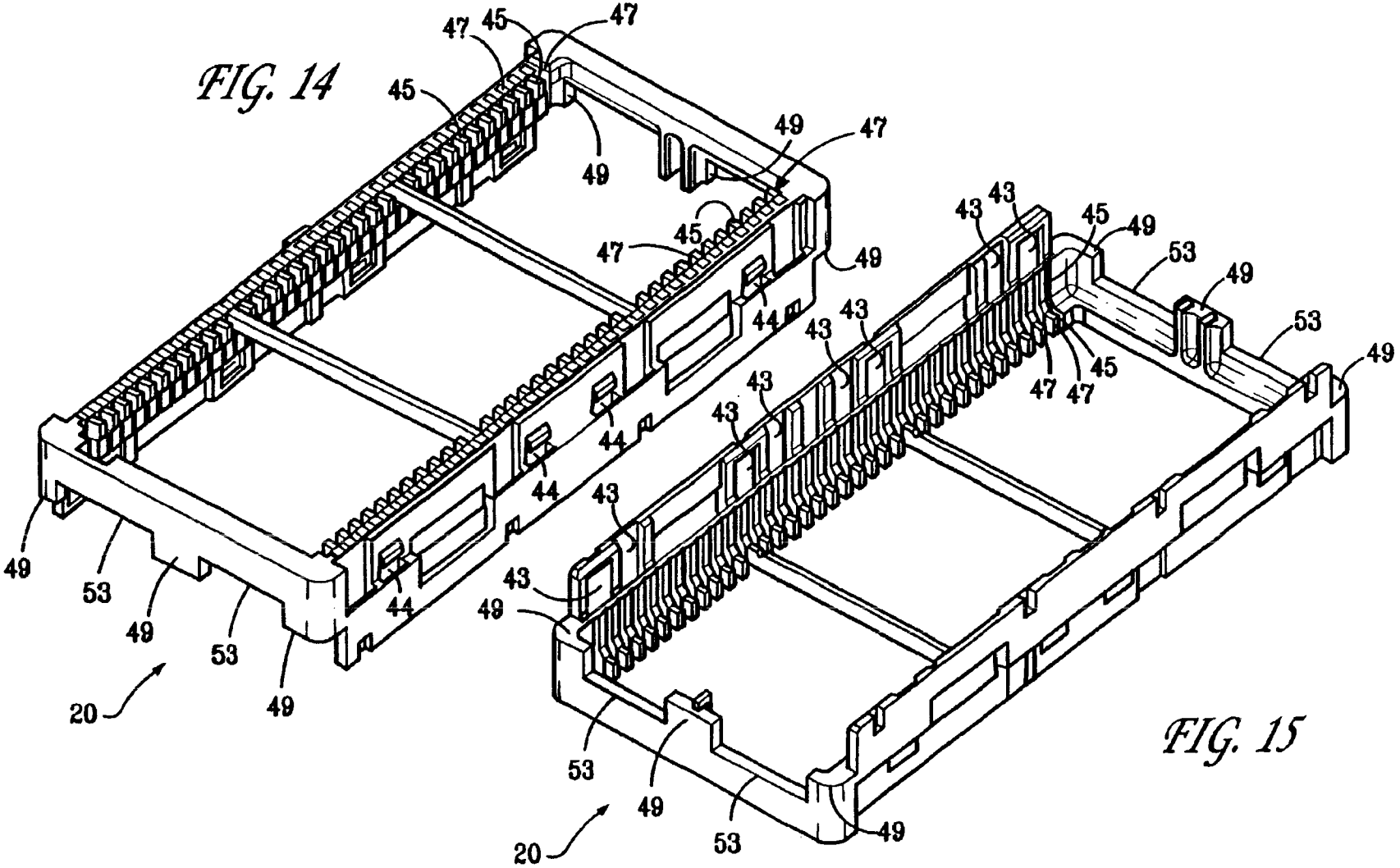
FIG. 14 is a perspective top view of a spacer according to a preferred embodiment of this invention.
FIG. 15 is a perspective bottom view of a spacer according to a preferred embodiment of this invention.

Top and bottom perspective views of the plug assembly 12 according to a preferred embodiment of this invention are respectively shown in FIGS. 1 and 2. The plug assembly 12 preferably includes the common base 14, a plurality of contact assemblies 16 and a plug cover 18. The plug assembly 12 may depending upon the contact height include a spacer 20, which is depicted in FIGS. 14 and 15. As shown in FIG. 1, the plug cover 18 is preferably mechanically coupled to the spacer 20 by any suitable means, including but not limited to the use of mechanical connections and adhesives. The spacer 20 is mounted to the base 14. This construction is also understood with reference to FIG. 3 which depicts a portion of the plug assembly 12 with the plug cover 18 detached from the spacer 20. (FIG. 3 depicts only a portion of the plug contact assemblies 16 installed, but it will be appreciated that the plug assembly 12 is filled with a plurality of such plug contact assemblies). Alternatively, for a lower stack height, the plug cover 18 can be mounted directly to the base 14, and a spacer 20 need not be used. (Although the plug assembly 12 is depicted in FIG. 1 and the receptacle assembly 13 is depicted in FIG. 17 as each having a cap 12*a* and 13*a*, it will be appreciated that these caps 12*a*, 13*a* (which can be the same cap) are used for manufacturing purposes and do not form part of the connector described herein. These caps 12*a*, 13*a* are for lifting the assemblies during handling and manufacturing. For example, the assemblies 12, 13 can be vacuum lifted by applying a suction to the caps 12*a*, 13*a*).

Figures 4, 5:
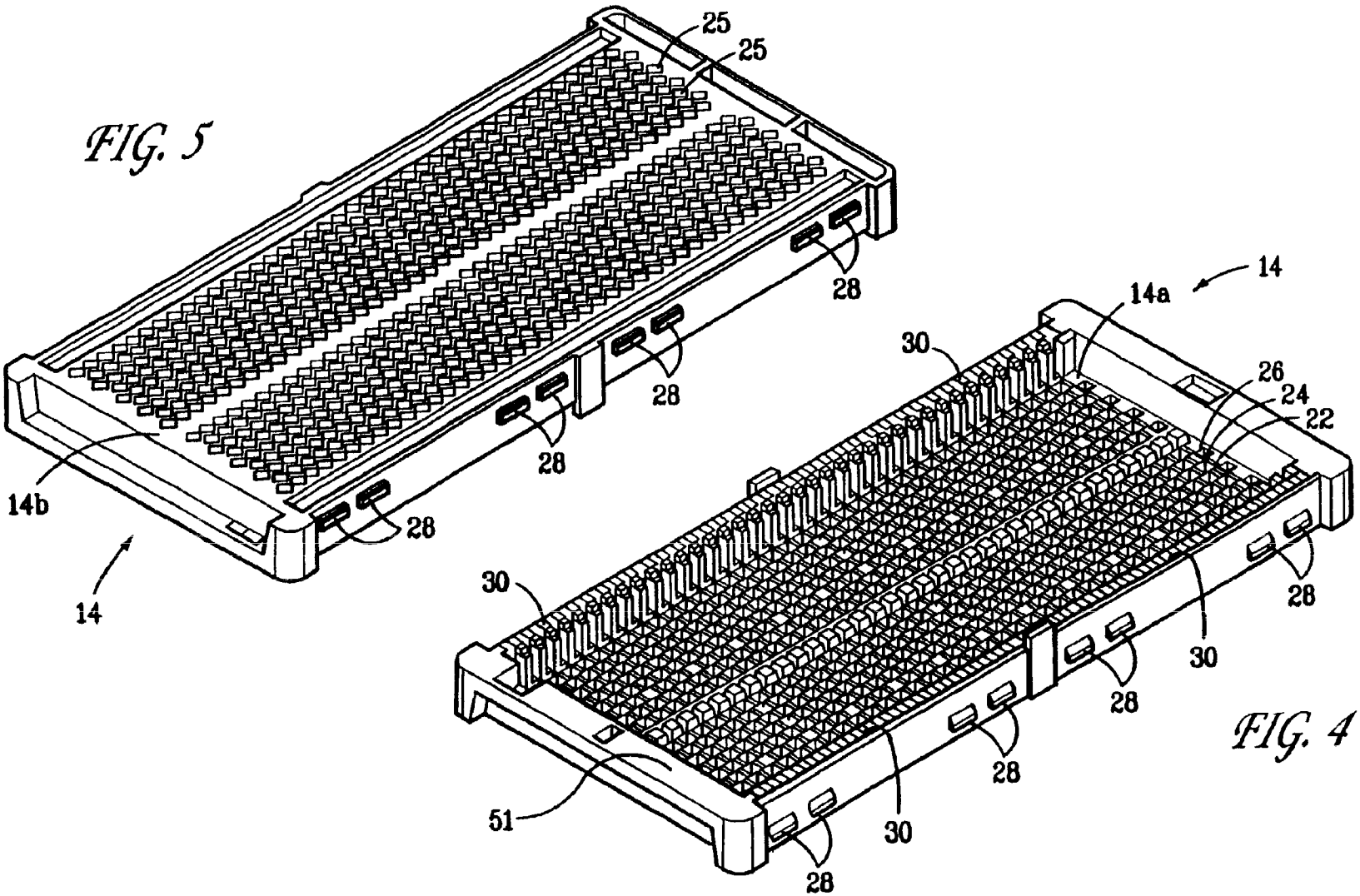
FIG. 4 is a top perspective view of a preferred embodiment of a common base for the plug assembly of FIGS. 1 and 2 and the receptacle assembly of FIGS. 17 and 18.
FIG. 5 is a bottom perspective view of a preferred embodiment of a common base for the plug assembly of FIGS. 1 and 2 and the receptacle assembly of FIGS. 17 and 18.

A preferred embodiment of the common base 14 for the plug assembly 12 and the receptacle assembly 13 is depicted in FIGS. 4 and 5. This base 14 is a common component that can be used to form both the plug and the receptacle. FIG. 4 is top perspective view of the top 14*a* of the base 14, and FIG. 5 is a bottom perspective view of the bottom 14*b* of the base 14. The base 14 may be constructed from any suitable material and is preferably a polymeric material. Moreover, the base can be constructed in a single piece as shown in the preferred embodiment, which is a single piece of molded plastic, or any number of pieces.

Figure 6:
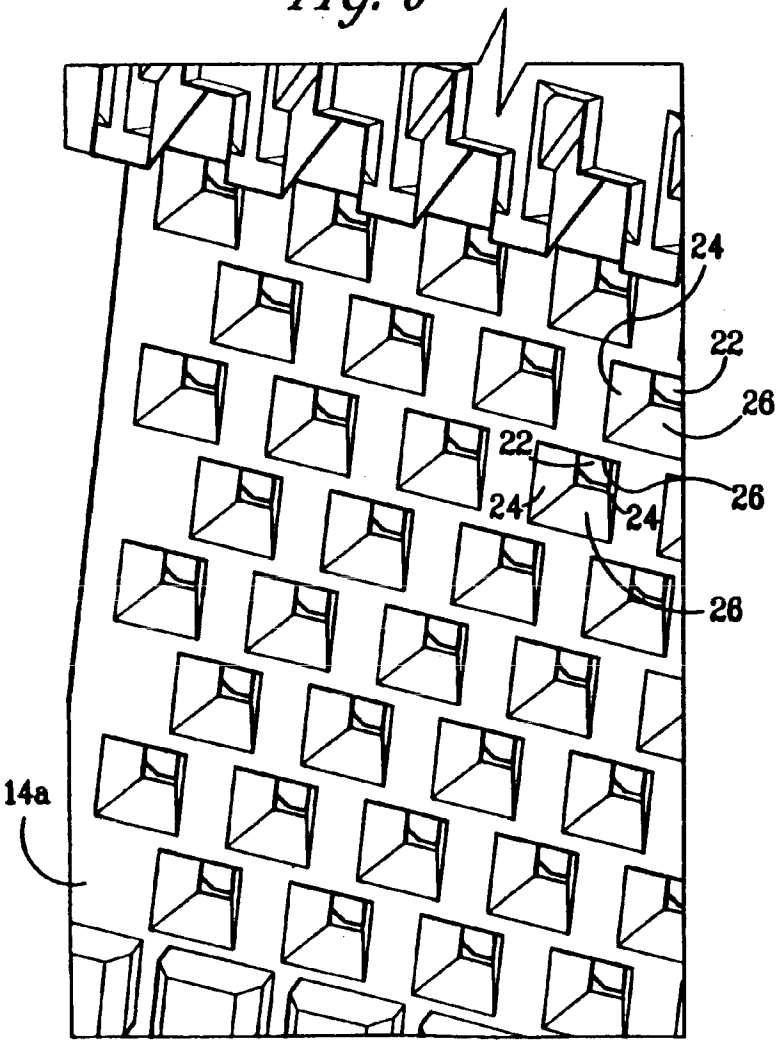
FIG. 6 is a perspective view of a portion of the top of the common base of FIG. 4.
Figure 8:
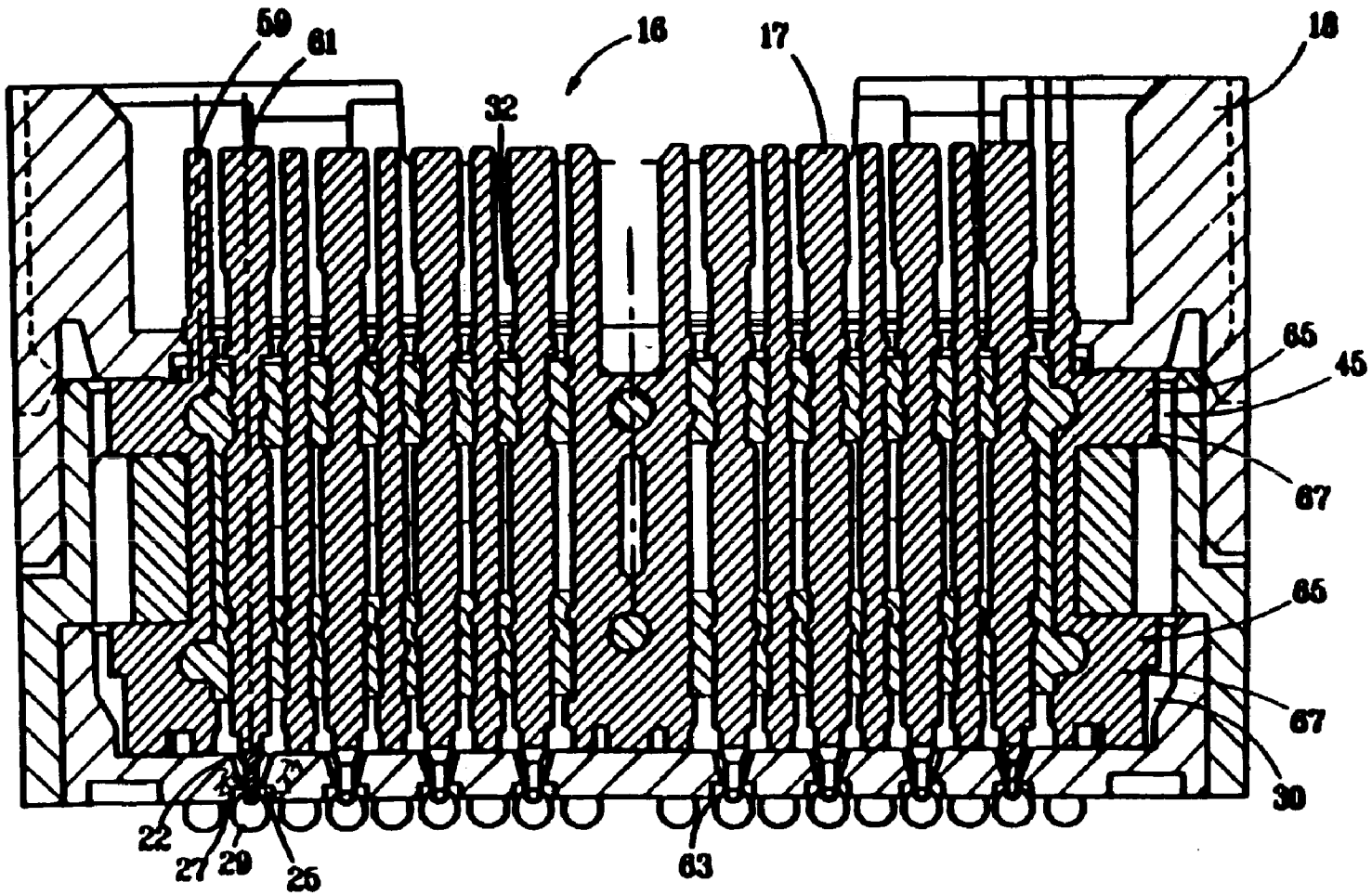
FIG. 8 is a cross-section taken along line 8—8 of FIG. 1.

As shown in FIG. 4, the top 14*a* of the base 14 includes a plurality of recesses 22. A closer view of a preferred embodiment of the recesses 22 is shown in the perspective view of FIG. 6. Each of the recesses 22 are preferably defined by two pairs of opposing angled walls 24, 26. The angled walls 24, 26 approach each other but do not touch so that they in part define a recess 22. As explained in more detail below and as shown in FIG. 8, one end of a plug contact of a plug contact assembly 16 fits within each recess 22 if the base is to be used as part of a plug assembly. Alternatively, if the base 14 is to be used as a base of a receptacle assembly, a receptacle of a receptacle contact assembly can be inserted into the recess 22. The construction of the contact plug assemblies 16 is further described below.

Figure 7:
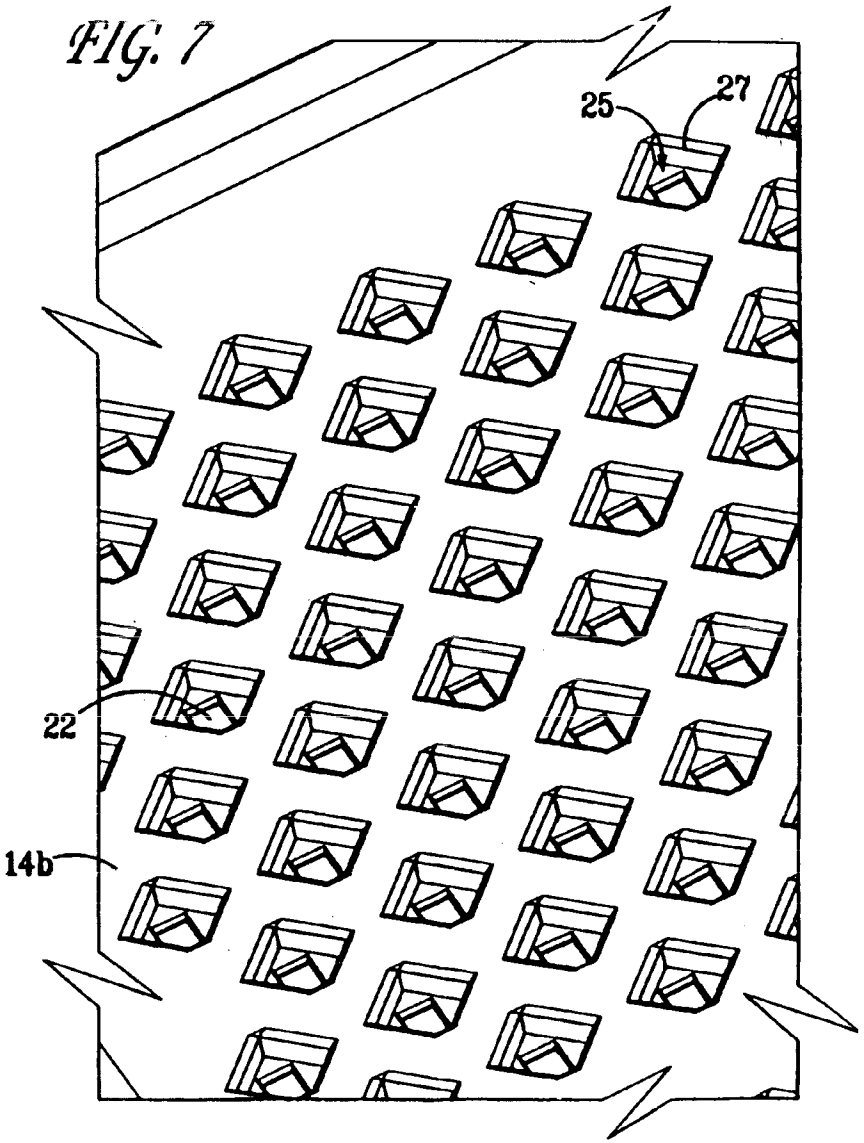
FIG. 7 is a perspective view of a portion of the bottom of the common base of FIG. 5.

FIG. 5 depicts the bottom view of the perspective view of the base 14, and FIG. 7 depicts an enlarged view of a portion of the bottom 14*b* of the base 14. As shown best in FIG. 7, the recesses 22 are defined so that they are preferably substantially rectangular shaped. The bottom 14*b* of the base 14 has a plurality of pockets 25 which are defined by walls 27. The walls 27 are preferably configured to define the pockets in a diamond shape, as shown in FIG. 7.

Figure 9:
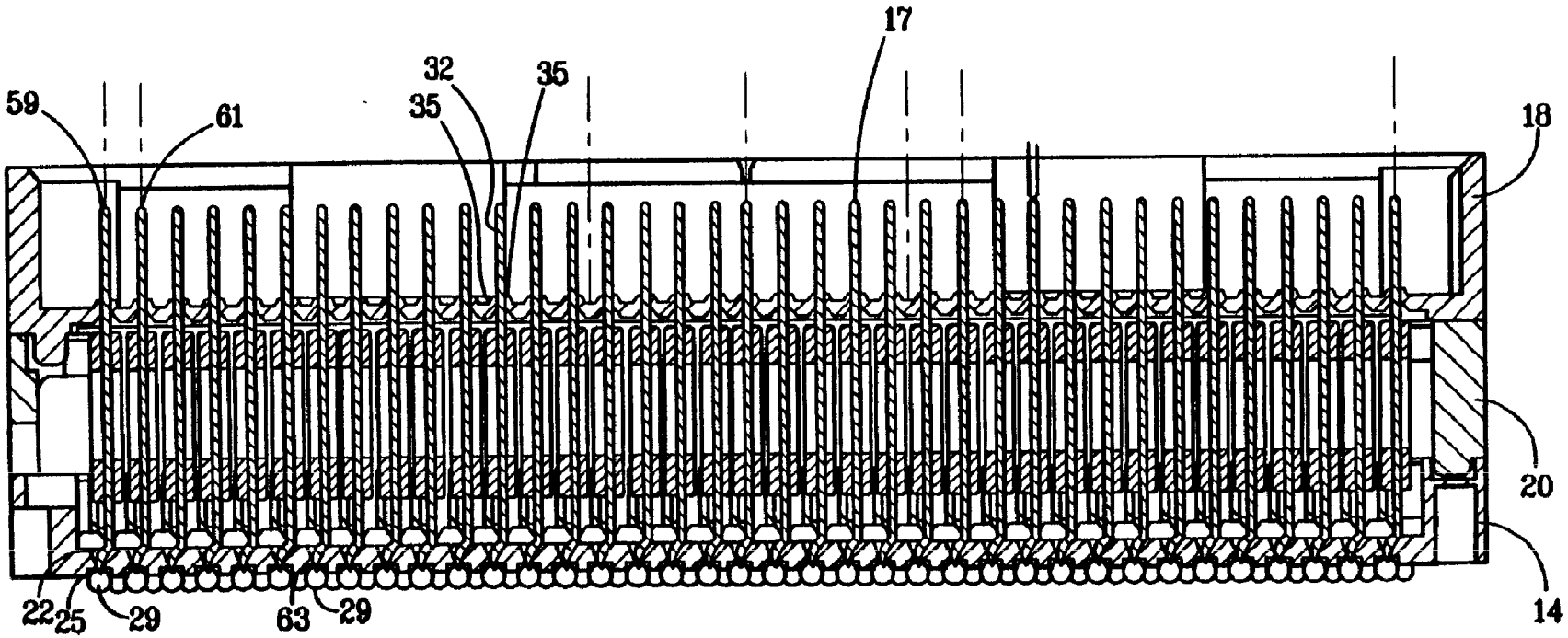
FIG. 9 is a cross-section taken along line 9—9 of FIG. 1.

Moreover, a ball grid array connector, which is preferably a fusible element and even more preferably solder, can be disposed within each pocket 25 so that each fusible element is in electrical contact with a contact that extends through the recess 22. This is best understood with reference to FIGS. 8 and 9 which are cross-sections through the plug assembly 12 of FIG. 1. In the embodiment shown the fusible element is a solder ball. The term ball is not meant to be limiting as to a particular geometric configuration of the solder. As shown in FIGS. 8 and 9 the solder balls 29 are disposed in the pockets 25 and the plug contacts extend through the base recesses 22 into the pockets 25. Each plug is wetted to a solder ball 29 in the respective pocket 25. The base 14 can be mated to an electrical component in order to form an electrical connection between the solder balls 29 and a circuit. For example, the base 14 can be mated to a board having an integrated circuit to form electrical connections between the solder balls and the circuit.

As shown in FIGS. 5 and 7, the pockets 25 are generally disposed in a pattern of alternating rows such that the centerline of each pocket 25 is aligned with a centerline of another pocket 25 that is two rows away from that pocket 25. Alternatively stated the pockets 25 are preferably disposed in an interstitial diamond shaped pattern. This diamond shaped interstitial pattern permits the contacts to be more closely packed while maintaining standard commercial pocket dimensions and using standard BGA solder balls. This diamond orientation also provides for additional clearance for the contacts. In particular, with the diamond pocket 25 of FIG. 7, there will always be clearance around the entire periphery of the end of the contact extending through the recess even if the contact is not centered within the recess 22. In contrast, in some prior designs the recess 22 and the pocket 25 were both rectangular shaped and the contact if not centered could push against the walls which define the recess or pocket. In such designs, the potential exists that the solder would not extend around the entire periphery of the contact end if the contact was not centered within the recess 22. If solder does not surround the entire periphery of the contact end, then the mechanical integrity of the connection between the solder, the contact and another electrical component can be degraded.

Figure 7A:
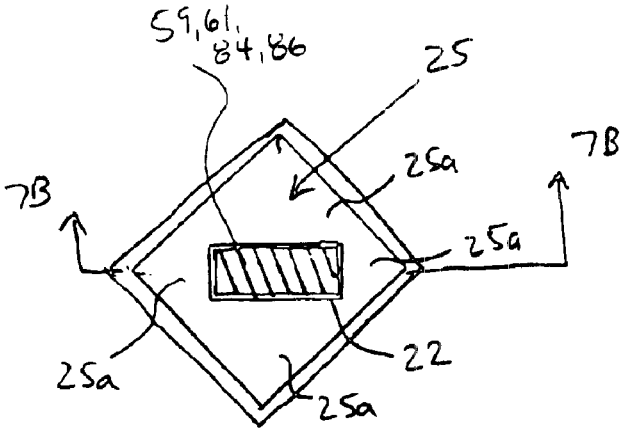
FIG. 7A is a cross section taken through line 7A—7A of FIG. 8.
Figure 7B:
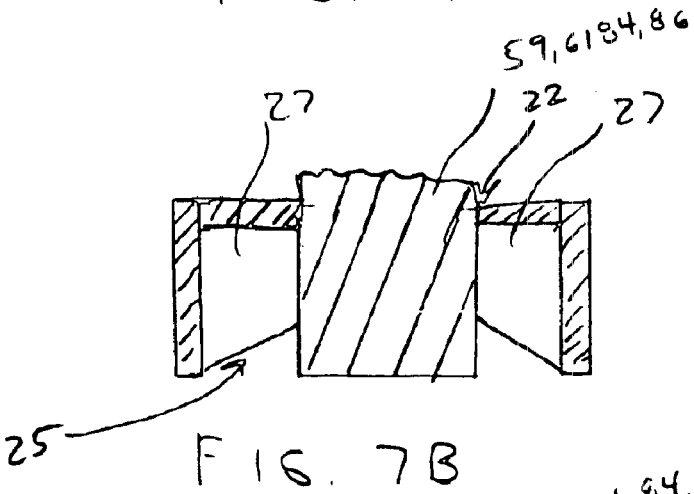
FIG. 7B is a cross-section through line 7B—7B of FIG. 7A.
Figure 7C:
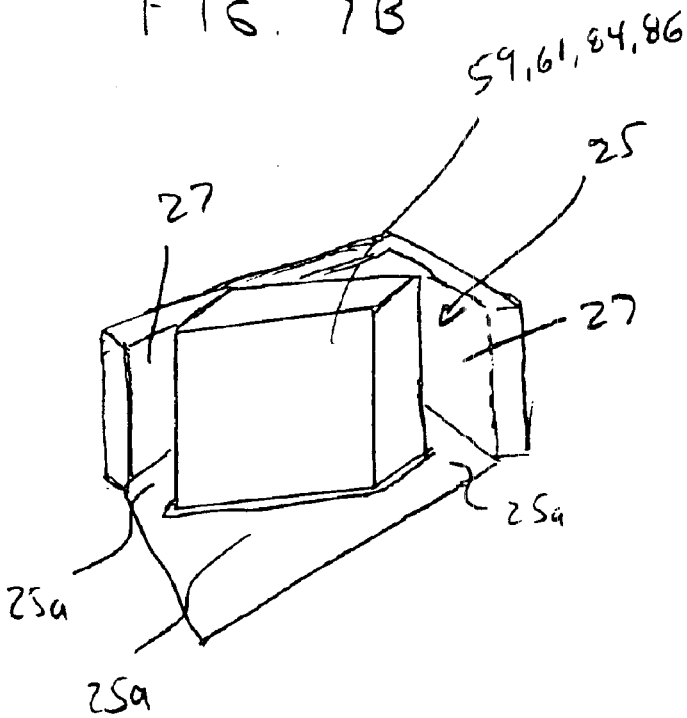
FIG. 7C is a cut away perspective view of a contact end extending through a pocket looking down into a pocket.

FIGS. 7A–7C depict the end of a contact (could be any of the contacts 59, 61, 84, 86 described in detail below) extending through a pocket 25. FIGS. 7A and 7B are cross-sections showing a contact end extending through a recess 22 and a pocket 25. FIG. 7C is a cut away isometric view showing the contact end extending through the recess 22 and the pocket 25. It will be appreciated that the other contacts likewise extend through the other pockets 25 and recesses 22 as shown in FIG. 8. FIG. 7C is a cut away perspective view looking down into a pocket as in FIG. 7 with a contact 59, 61, 84, 86 extending through the recess into the pocket and there being the gap 25*a* disposed around the contact. It will also be appreciated that although FIGS. 7A and 7B are cross-sections through the plug assembly, the receptacle assembly is in this respect similar, as it contacts also extend through the recesses into the bases pockets in the interstitial diamond configuration. As shown with the diamond configuration, wetting around the entire periphery of the contact end extending through the recess 22 is ensured because there is a gap 25*a* around the periphery of the contact end within the pocket due to the diamond shape. This is also shown with reference to FIG. 7 and FIG. 8.

As will be generally understood, the plug and the receptacle assemblies 12, 13 will undergo power and thermal cycles, which induce thermal stresses upon the contact and the solder. Having solder around the entire perimeter of the end of the contact is beneficial because areas of a contact end which do not have solder wetting (solder attached to the contact) are more susceptible to these stresses. Therefore, having solder around the entire perimeter of the contact can enhance ball retention and T-cycle life.

As best shown in FIGS. 4 and 5, the base 14 may also have a plurality of tabs 28 extending from opposing sides. These tabs 28 as explained further below fit with channels 38 disposed within the plug cover 18 (shown in FIGS. 10, 11), channels 43 in the spacer 20 (shown in FIGS. 14 and 15) or channels 80 in the receptacle cover 70 (which is described below and shown in FIGS. 20 and 21) in order to attach the base 14 to either the plug cover 18, the spacer 20 or the receptacle cover 70. Although tabs 28 and channels 38, 43, 80 are used as a connection means in the preferred embodiment, any suitable attachment means can be used. For instance, other connection means can be used including but not limited to fasteners and adhesives.

Slots 30, as are also shown in FIG. 4, may also be disposed within the base 14. Slots 30 are constructed to receive a contact assembly either a plug contact assembly 16 or a receptacle contact assembly 72 (which is discussed in more detail below and shown in FIGS. 19 and 24) so that a contact assembly 16, 72 can be mounted within the base 14. Attachment of the contact assemblies, both base and receptacle assemblies, are described in further detail below.

Figures 10, 11:
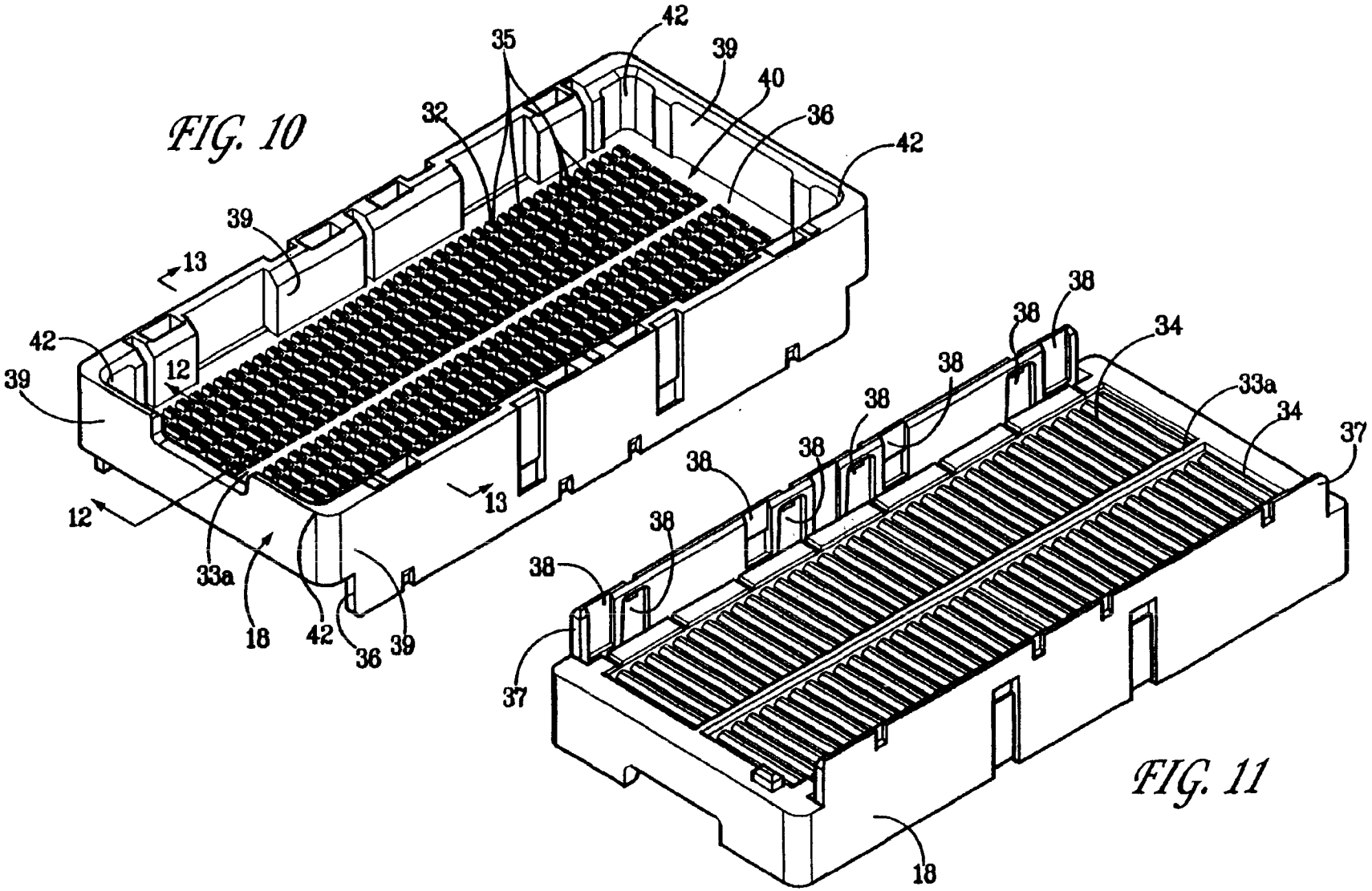
FIG. 10 is a perspective top view of a plug cover of the plug assembly of FIG. 1 according to the preferred embodiment of the invention.
FIG. 11 is a perspective bottom view of a plug cover of the plug assembly of FIG. 1 according to the preferred embodiment of the invention.

An embodiment of the plug cover 18 is depicted in FIGS. 10 and 11. FIG. 10 depicts an isometric top view of the plug cover 18, and FIG. 11 depicts an isometric bottom view. As shown the plug cover 18 is preferably a single molded piece, but alternatively may be constructed from a variety of pieces. The plug cover 18 can be constructed from any suitable material, but preferably a polymeric type material is used.

As shown in FIGS. 3 and 10, the plug cover 18 may have a plurality of slots 32 which can each receive a plug contact as best understood with reference to FIGS. 1 and 3. FIG. 1 depicts the plug contacts extended up through the slots 32, and FIG. 3 depicts slots 32 being inserted over the plug contacts 59, 61. In the preferred embodiment shown, the slots 32 are arranged in rows and there are ten tines 35 per row. There can be, however, any number of slots 32 and the tines 35 can be arranged in numerous other configurations.

Figure 12:
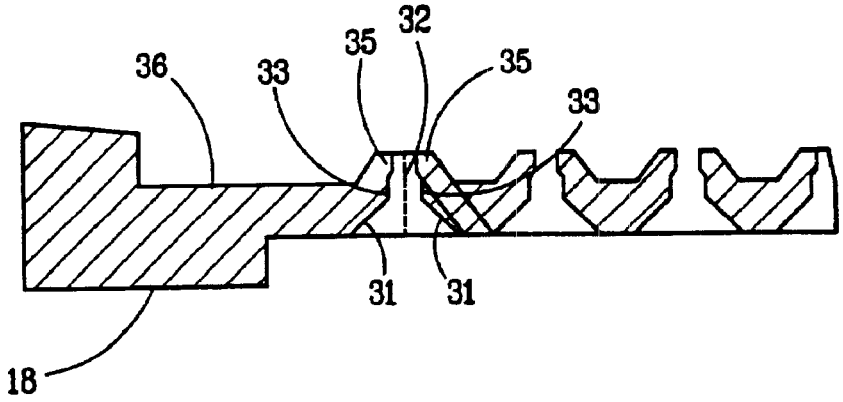
FIG. 12 is a cross-section taken along line 12—12 of FIG. 10.
Figure 13:
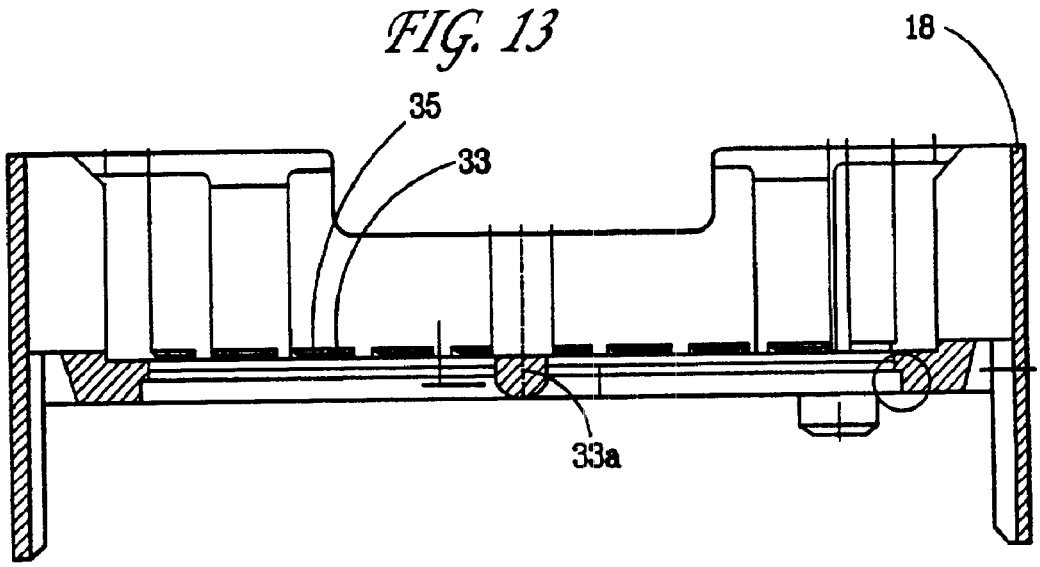
FIG. 13 is a cross-section taken along line 13—13 of FIG. 10.

The under side of the slots 32 in each row are two continuous slots 34 as shown in FIG. 11. FIG. 12 is a cross-section taken along line 12—12 of FIG. 10 through a few of the slots 32. As shown, the slots 32 are in the preferred embodiment defined by a pair of opposed sides 31 which are preferably angled away from each other in order to facilitate the insertion of a contact through them. Walls 33 also define a substantially vertically section of the slots 32. The slots 32 may further be defined by tines 35 which extend, as shown in FIGS. 10 and 12, above the outer surface 36. These tines 35 provide additional support for the plug contacts and further narrow the slots 32, as is also shown in FIG. 9. It will be appreciated that a variety of other constructions can be used to form the slots 32. A support member 33*a*, which is in the preferred embodiment integrally formed with the plug cover 18 as shown in FIGS. 11 and 13, extends longitudinally across the middle of the plug cover 18 to provide alignment for the plug contact assembly.

Extending from opposing sides of the plug cover 18 may be members 37 that define channels 38. The tabs 28 of the base 14 fit into the channels 38 in order to snap fit the base 14 to the plug cover 18. Alternatively, tabs 44 on the spacer 20 as explained below fit into the channels 38 in order to attach the plug cover 18 to a spacer 20. This construction is shown in the preferred embodiment of FIG. 1. In the preferred embodiment shown, there are eight channels 38 on each member 37 that mate with the eight tabs 28 of either the base 14 or the spacer 20, but any suitable number may be used. Alternative means may be used to attach the plug cover 18 to either the base 14 or the spacer 20.

The plug cover 18 has walls 39 which are preferably sized and shaped to define an interior 40 for receiving a receptacle assembly. Preferably, the receptacle assembly 13 fits snugly within the interior 40 so that a sliding fit is created. The corners 42 of the walls 39 are preferably sized and shaped so that the corners of the receptacle assembly discussed below will snugly fit within the walls 39. It will be appreciated that the plug 12 and the receptacle 13 can fit together with numerous other constructions, and this is one example of a preferred way to attach the two assemblies 12, 13. One or more corners of the plug assembly can be sized or shaped so that those corners mate with only a specific corner of a correspondingly sized or shaped corner of the receptacle cover. This ensures that the covers are mated in the proper orientation.

FIGS. 14 and 15 depict perspective views of a preferred embodiment of a spacer 20. FIGS. 14 and 15 are respectively top and bottom perspective views. Preferably, the spacer 20 is a single molded piece. Alternatively, the spacer 20 can be constructed from a plurality of pieces. The spacer 20 may be a polymeric material, but any suitable material may be used. Spacers 20 of different heights can be used with either the plug assembly 12 or the receptacle assembly 13 in order to achieve a connector of the desired stack height. For greater stack heights, taller or more spacers are used and for lesser stack heights smaller or less spacers are employed. In the preferred embodiment, a single spacer 20 is used in the plug assembly 12 and is connected to the base 14 and the plug cover 18 as shown in FIG. 1.

The spacer 20 preferably has any suitable means for connecting the spacer 20 to a base 14 or a plug cover 18. In the preferred embodiment shown, the connecting means is a mechanical type connection means and includes the channels 43, which can be mated with tabs 28 of the base 14. The spacer may also have tabs 44 to snap fit the spacer to the channels 38 of the plug cover 18. Preferably, the spacer 20 has channels 43 and tabs 44 on two opposing sides of the spacer 20. Although only one side is shown in FIG. 15, it will be appreciated that the other side is similarly constructed.

Disposed within the spacer 20 may be a series of grooves 45 for receiving a contact assembly. The grooves 45 are preferably defined by a plurality of inwardly extending partitions 47 which support the lateral ends of a contact assembly.

The spacer 20 may also have a plurality of legs 49 extending downward. These legs 49 rest on the upper surface 51 of the base 14 when the spacer is disposed on the base 14, as shown in FIGS. 1 and 3, and as also understood by comparing FIGS. 14 and 4. The spacer 20 has surfaces 53 which create windows 55 when mated with the base 14, as best understood in FIG. 3. These windows 55 serve to reduce the weight of the spacer 20 and provides a flow path for air into the plug assembly for cooling. The windows 55 are also preferably asymmetric with respect to the centerline. This assists in manufacturing the plug assembly and in orienting the spacer 20 in a vibratory feed system.

Figure 16:
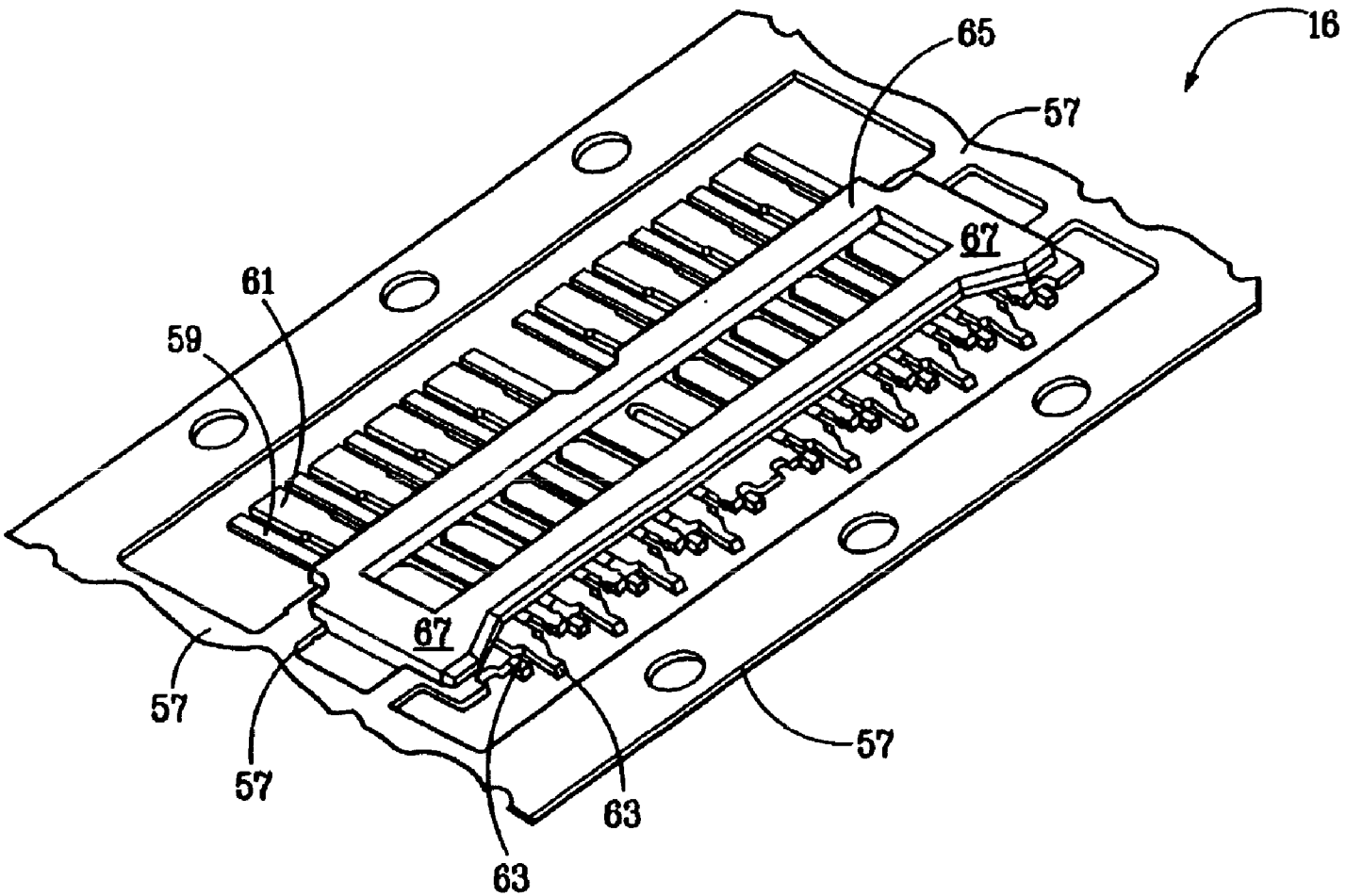
FIG. 16 is a perspective view of a plug contact assembly before being singulated.

FIG. 16 depicts preferred embodiment of a plug contact assembly 16 for use with the plug assembly of FIG. 1 before the contact assembly 16 is singulated to remove portions 57. The plug contact assembly 16 includes a plurality of alternating ground 59 and signal contacts 61. Any number of such contacts can be used to create a plug contact assembly. In a preferred embodiment, ten ground 59 and eight signal contacts 61 are employed.

The contacts 59, 61 need not be but may be gold striped at their ends 63 which are connected to the solder balls as shown in FIGS. 8 and 9, to improve wetting of the contacts 59, 61. The mating ends of the contacts 59, 61 can also be gold striped to provide high reliability and relatively low mating forces. The remaining portion of the contacts 59, 61 can be nickel plated to prevent the solder from traveling up the contacts 59, 61. FIG. 8 is a cross-section depicting a plug contact assembly 16 inserted into the plug assembly 12 and shows the ends 63 of the signal contacts connected to a solder ball 29 in a ball pocket 25 of the base 14. It will be appreciated that the ends of the ground contacts 59 of the contact assembly shown are in a different plane but are likewise wetted to a solder ball in a ball pocket of the base 14. As shown, the ends 63 of the contacts, extend through the recesses 22 in the base 14 and to the diamond pockets 25 where solder 29 is used to create a solder ball for electrical connection to another electrical component. This is also shown in FIG. 9 which depicts a longitudinal cross section through the plug assembly 12. As shown each contact 59 is wetted to the solder 29 in a pocket 25 of the base 14.

The contacts 59, 61 can be stamped and then molded to a plastic carrier 65 an embodiment of which is shown in FIG. 16. The ends 67 of the carrier 65 are preferably sized and shaped so that they can fit relatively snugly within the slots 30 of the base 14 and the grooves 45 of the spacer 20. This is best understood with reference to FIG. 3, which shows a plurality of contact assemblies 16 inserted into the grooves 45 of the spacer 20, and FIG. 8, which is a cross-section depicting the plug contact assembly 16 inserted into the slots 30 of the base 14 and the groove 45 of the spacer 20.

The assembly of the plug assembly 12 can best be understood by starting with a base 14, as shown in FIGS. 4 and 5. A spacer 20, if used, can be snap fit to the base 14 by snapping the tabs 28 of the base 14 into the channels 43 of the spacer 20 as shown in FIG. 15. The contact assemblies 16 can then be inserted into each of the slots 30 in the base 14 and grooves 45 of the spacer 20. Then as shown in FIG. 3, a plug cover 18 can be snap fit to the spacer 20 with tabs 44 and channels 38. Solder can then be inserted in each pocket around the contact end 63 of the contacts 59, 61 to create the solder ball connections. The diamond shape construction of the pockets 25 ensures wetting around the perimeter of the contacts as described above.

If contacts of smaller heights are used, then the spacer 20 may not be required. In that event, the plug cover 18 can be attached directly to the base 14 with the base tabs 28 and the plug cover channels 38.

Receptacle Assembly

Figure 19:
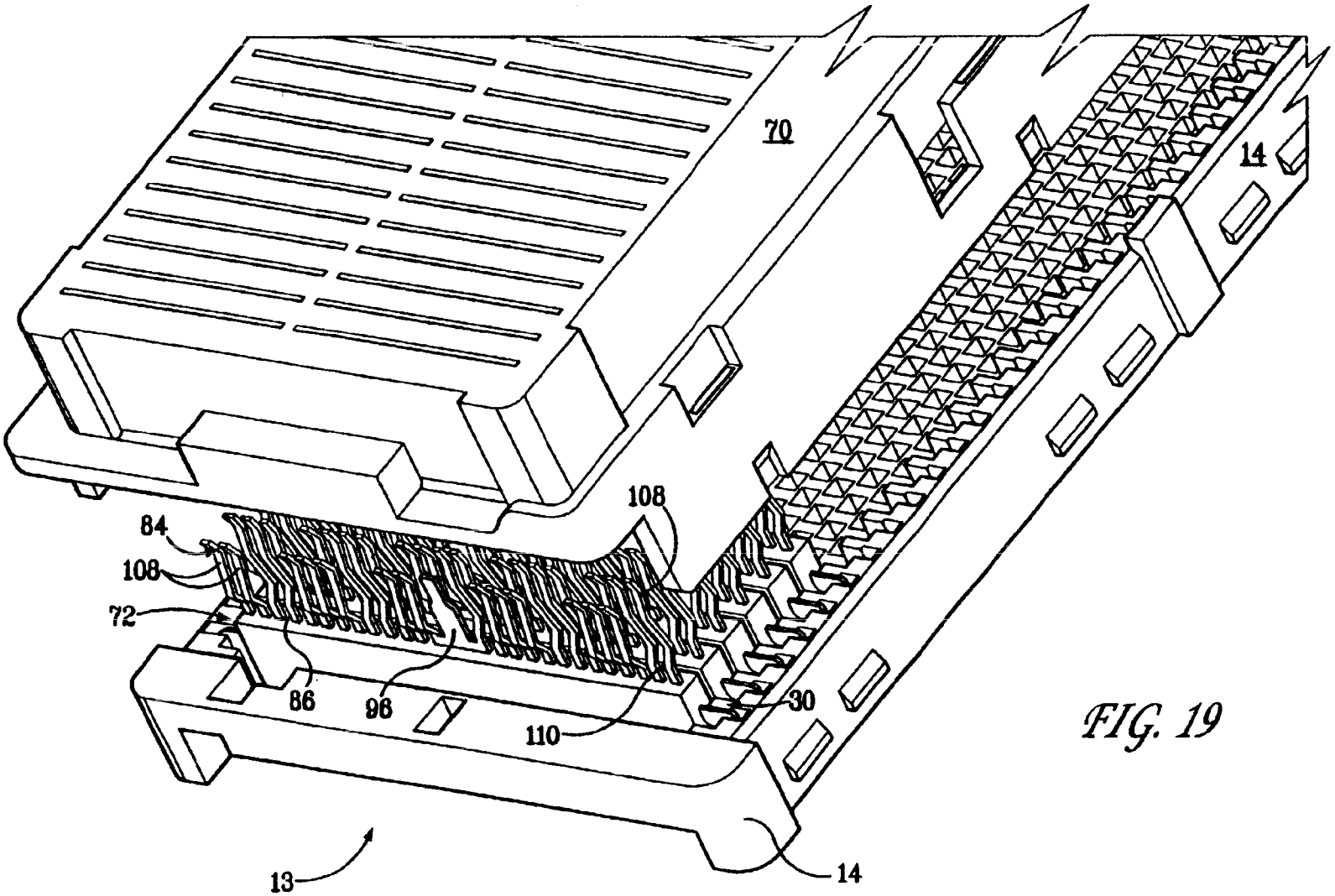
FIG. 19 is an assembly drawing of the receptacle assembly of FIGS. 17 and 18 with the receptacle cover removed.

A preferred embodiment of the receptacle assembly 13 to which the plug assembly 12 can be mated is shown in FIGS. 17 and 18. FIG. 17 is a perspective view of the top of the receptacle assembly 12, and FIG. 18 is a perspective view of the bottom or underside of the receptacle assembly 12. The receptacle assembly 13 generally includes a base 14, a receptacle cover 70 and a receptacle contact assembly 72, a plurality of which are depicted in FIG. 19. Although not shown in the preferred embodiment, a spacer 20 if needed based on contact height could be used between the base 14 and the cover 70. FIG. 19 shows the construction of the receptacle assembly 13 with a plurality of receptacle contact assemblies 72 inserted into the base 14, and the receptacle cover 70 being coupled to the base 14.

The base 14 of the receptacle assembly 13 is preferably the same base that is used in the plug assembly 12 and which is depicted in FIGS. 4–7. Thus, the construction of the receptacle base 14 can be understood by referring to the discussion above. By using a common base for the plug assembly 12 and the receptacle assembly 13, manufacturing is simpler and less costly in comparison to having to produce two different bases for the plug and the receptacle assemblies.

Figures 20, 21:
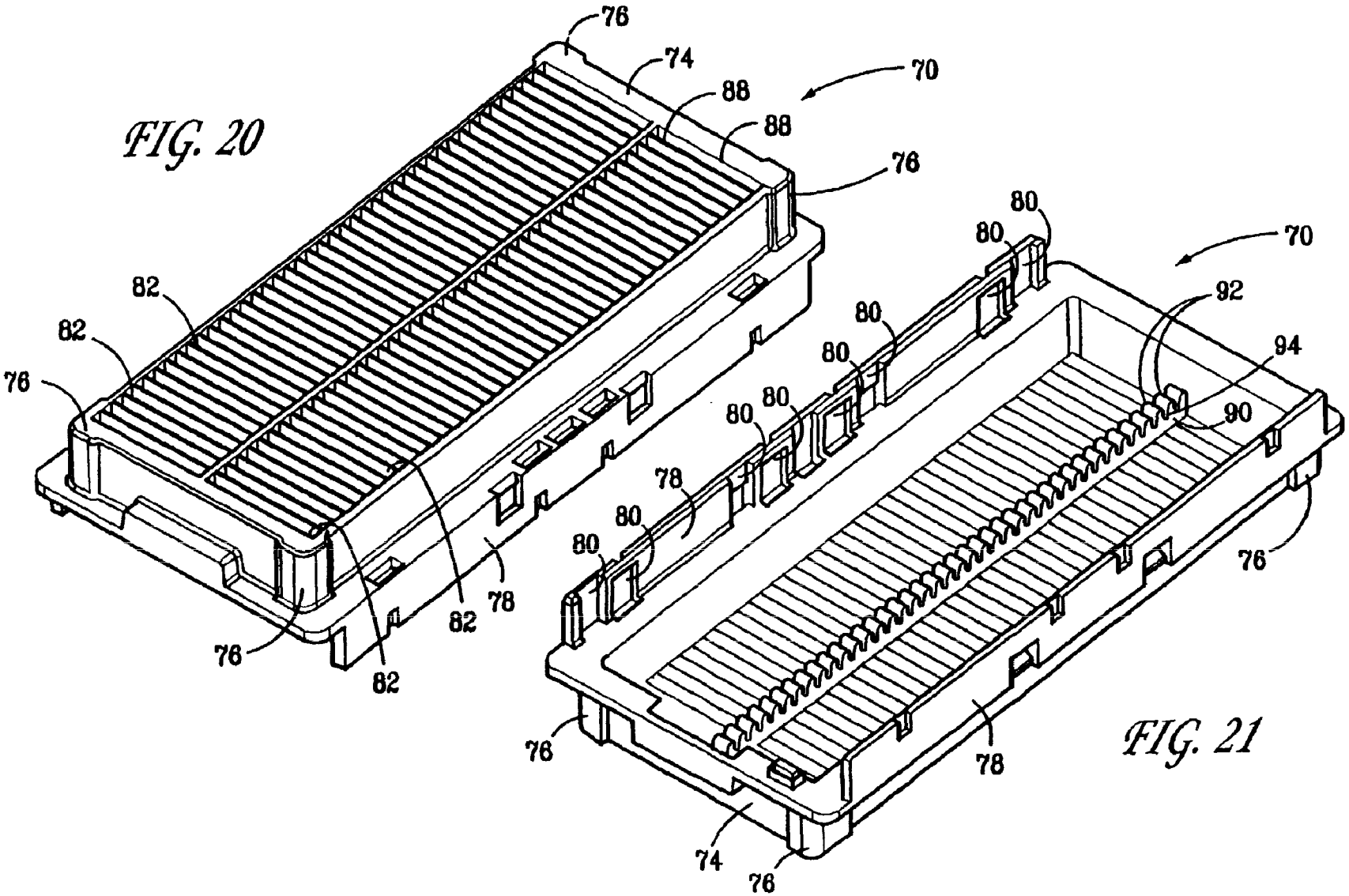
FIG. 20 is a perspective top view of a receptacle cover of the receptacle assembly of FIGS. 17 and 18 according to a preferred embodiment of this invention.
FIG. 21 is a perspective bottom view of a receptacle cover of the receptacle assembly of FIGS. 17 and 18 according to a preferred embodiment of this invention.

FIGS. 20 and 21 depict a preferred embodiment of the receptacle cover 70 which interfaces with the plug cover 18. FIG. 20 is a top isometric view of the receptacle cover 70, and FIG. 21 is a bottom isometric view. The receptacle cover 70 is preferably a single molded piece, but the receptacle cover 70 may be constructed from a multitude of pieces. Any suitable material but preferably a polymer can be used to manufacture the receptacle cover 70. The receptacle cover 70 preferably has a first portion 74 that is shaped so as to correspond to the interior 40 of the plug cover 18 so that the receptacle cover 70 slide fits into the interior 40 of the plug cover 18 as best understood with reference to FIGS. 1 and 17. It will be appreciated from viewing FIG. 1 that the plug cover 18 of the plug assembly 12 can fit over the receptacle cover 70 to connect the two assemblies and form a connector. The corners 76 of the receptacle cover 70 may be keyed or sized and shaped so as to slidingly engage the corners 42 of the plug assembly 12, so that the two assemblies slide together in an relatively snug sliding fit.

In a preferred embodiment, the receptacle cap 70 has laterally extending portions 78 that each comprise a plurality of channels 80 for receiving tabs 28 of base 14. In a preferred embodiment, there are eight channels 80 in each laterally extending portion 78. The receptacle cover 70 snap fits to the tabs 28 of the base 14 to form the receptacle assembly 13 shown in FIGS. 17 and 18.

Figure 22:
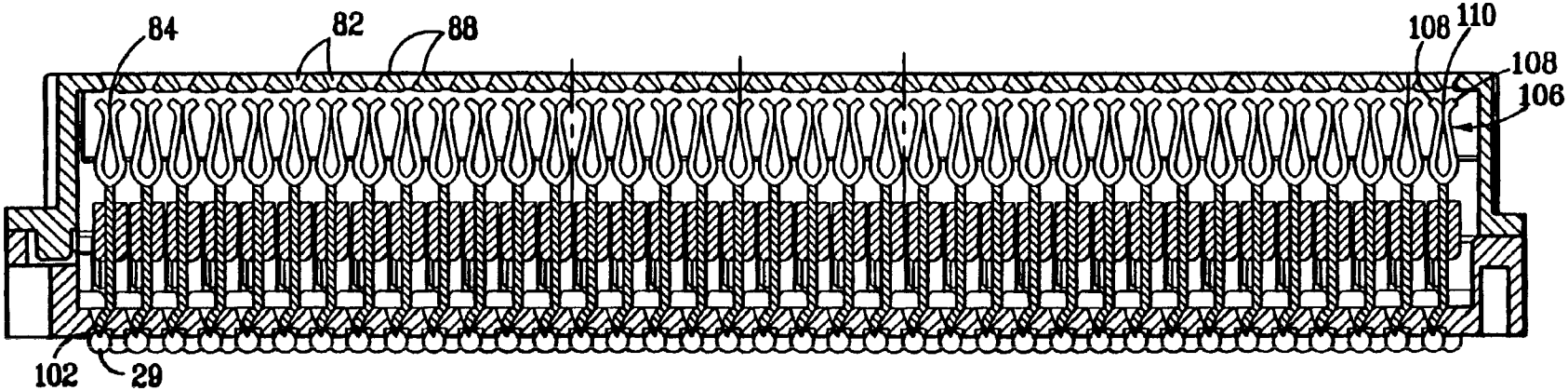
FIG. 22 is a cross-section taken along line 22—22 of FIG. 17.

The top of the receptacle cap 70 preferably has a plurality of laterally extending slots 82. These slots 82 are for receiving the plug contacts 59, 61. As will be appreciated by viewing FIGS. 1 and 17, the plug contacts can extend down through the slots 82 and mate with a corresponding receptacle contact 84 shown in FIG. 19. FIG. 22 also depicts the receptacle contacts 84 which are disposed beneath a slot 82. The slots 82 are preferably defined in part by opposing walls 88 which are angled toward each to direct the plug contacts 59, 61 to a corresponding receptacle contact 84, 86.

Figure 23:
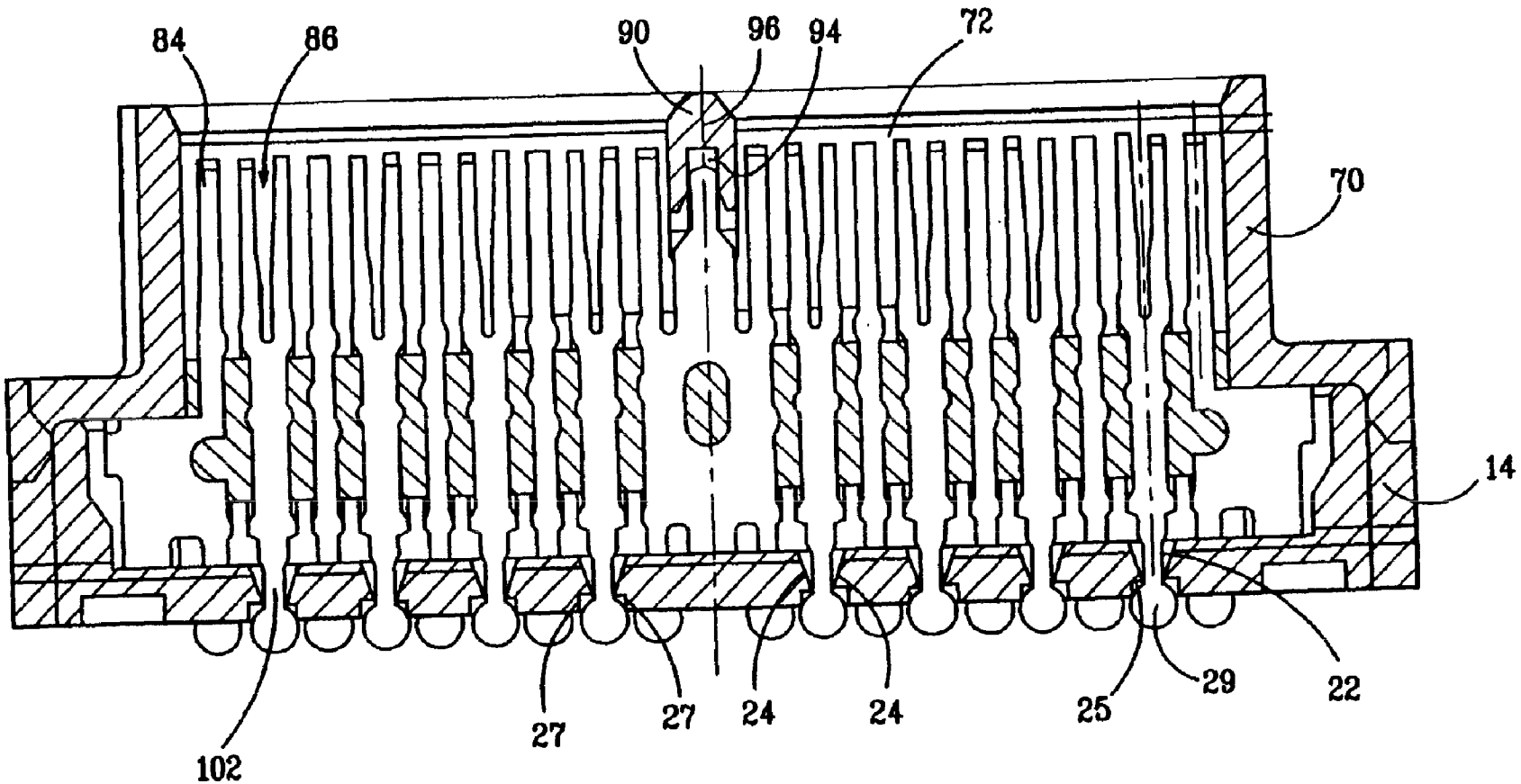
FIG. 23 is a cross-section taken along line 23—23 of FIG. 17.

Extending longitudinally along the underside of the receptacle cover 70 is preferably a support member 90. The support member 90 preferably has a plurality of ridges 92 and grooves 94 for receiving a receptacle contact assembly member 96, as shown in the cross-section of FIG. 23. As is also shown in FIG. 23, the contact assembly is preferably center aligned with the support member 96. By aligning the receptacle contact assembly in a groove of the support member 96, the contact assembly is aligned within the receptacle from the center. This is in contrast to a design in which the contacts assembly would be aligned from its lateral edges. This center alignment feature is a preference and the invention can be practiced with or without this feature and is only limited as stated expressly in the claims.

Figure 24B:
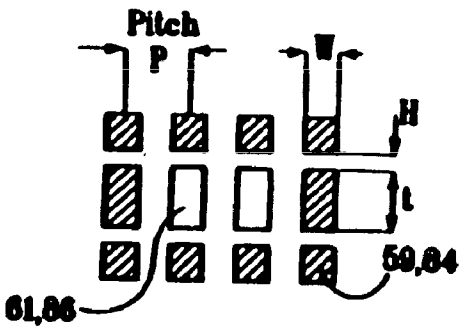
FIG. 24B is a schematic diagram of a second preferred signal and ground contact configuration.
Figure 24A:
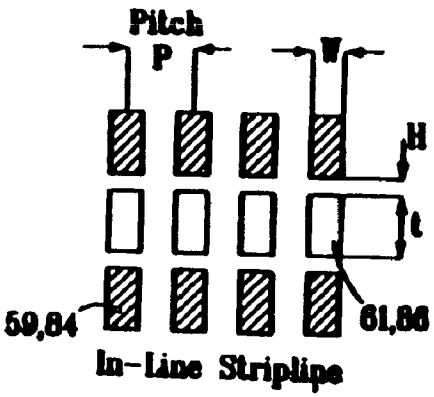
FIG. 24A is a schematic diagram of a preferred ground and signal contact configuration.
Figure 24:
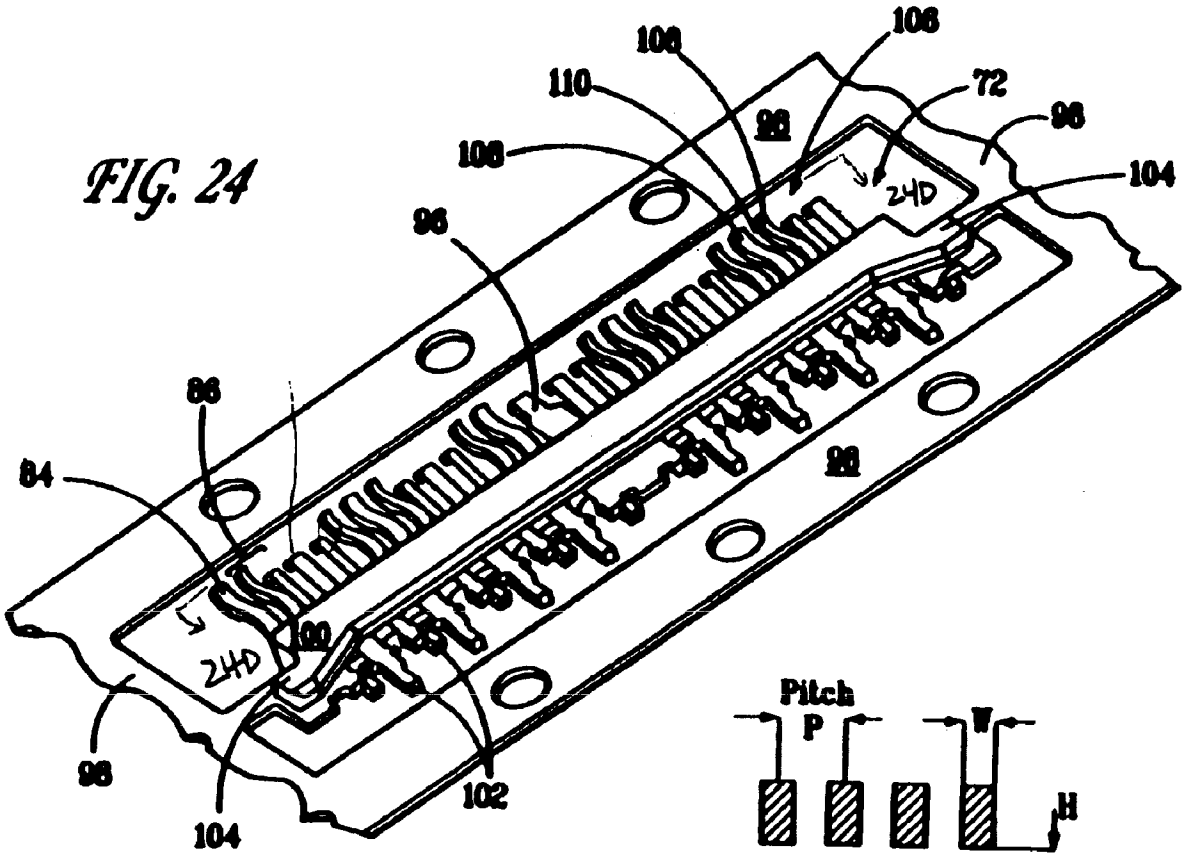
FIG. 24 is a perspective view of a receptacle contact assembly before being singulated.
Figures 24C, 24D:
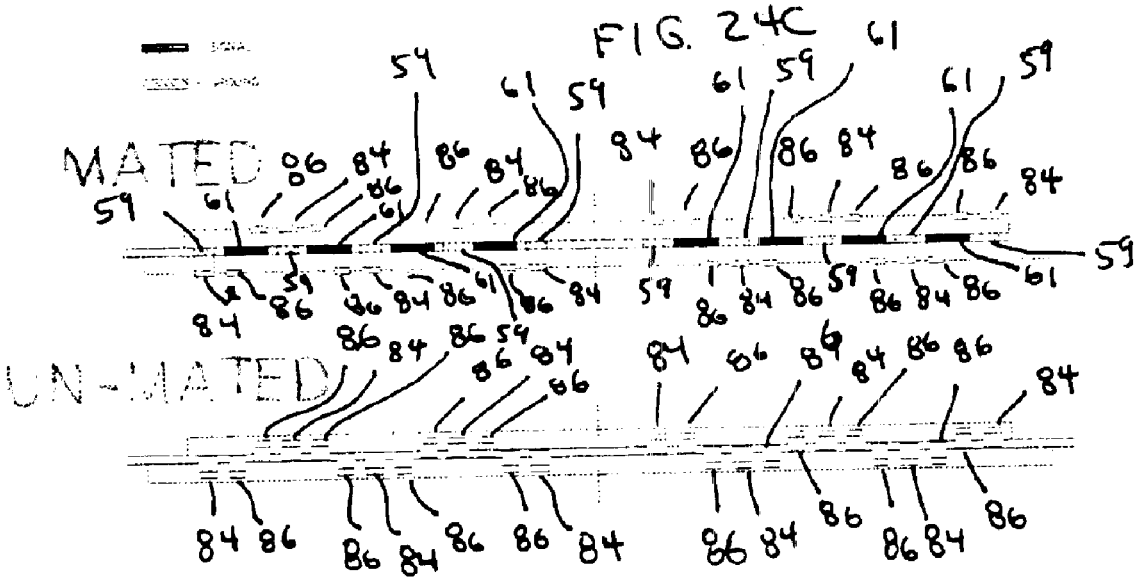
FIG. 24C is a cross-section taken through the plug contacts of FIG. 16 mated with the receptacle contacts of FIG. 24.
FIG. 24D is a top view of the receptacle contacts taken along line 24D—24D of FIG. 24.

FIG. 24 depicts a perspective view of a preferred embodiment of a receptacle contact assembly 72 that can be used with this invention before it has been singulated to remove portions 98. The receptacle contact assembly 72 includes alternating ground 84 and signal 86 contacts and a plastic carrier 100. FIG. 24D is a top view looking down onto FIG. 24 with the carrier 98 removed and depicts the arrangement of signal and ground contacts. Although the contacts differ in construction, the general construction of the receptacle contact assembly 72 can be understood with reference to the discussion regarding the plug contact assembly 16. The receptacle contacts are preferably stamped and then molded to a plastic carrier 100. They are then singulated to remove unwanted portions 98. The ends 102 of the receptacle contacts can be but need not be gold striped to ensure wetting with solder 29 when disposed in a base pocket 25 as shown in FIGS. 22 and 23. The mating ends of the contacts can also be gold striped for high reliability and to reduce mating forces. The ends 104 of the plastic carrier 100 are preferably sized and shaped so that they can be inserted into the slots 30 of the base 14, as shown in FIG. 19.

The receptacle contact assembly 72 can also have support member 96 which as shown in the cross-section of FIG. 23 fits relatively snugly within a groove 94 defined by two of the ridges 92 in the support member 90 of the receptacle cover 70. This provides stability for the receptacle contact assembly 13.

As shown in FIGS. 19, 22 and 24, one end of the receptacle contact 106 has groups of opposing forks 108 that define a space 110 for receiving a plug type contact 59, 61. As will be appreciated by viewing the plug contacts 59, 61 in FIG. 3, a plug contact 59, 61 can fit between the forked end 108 of a receptacle contact 84, 86 in order to provide an electrical connection.

The receptacle assembly 13 can be constructed by inserting a plurality of receptacle contact assemblies 72 into the slots 30 of the base 14, as best understood with reference to FIG. 19. As described above, the ends 104 of the plastic carrier 100 are sized and shaped so as to fit relatively snugly within the slots 30. The receptacle cover 70 snap fits over the base 14 by snapping the tabs 28 of the base 14 into the channels 80 of the receptacle cover 70, as shown in FIG. 19. When the receptacle cover 70 is attached to the base 14, the support members 96 of the receptacle contact assemblies 72 fit within the grooves 94 of the receptacle cover support member 90.

Mating of the Plug and Receptacle Assemblies

The plug and receptacle assemblies 12, 13 are mated by inserting the receptacle cover 70 into the interior 40 of the plug cover 18. The receptacle corners 76 of the receptacle cover 70 fit relatively snugly into the corners 42 of the plug cover 18 to form a sliding and keyed fit. When coupled together, the plug contacts 59, 61 shown in FIG. 3, extend through the slots 82 of the receptacle cover 70 and mate with a corresponding receptacle contact 84, 86 to create an electrical connection between each contact. The connector can be mated to other electrical components such as printed circuit boards which have circuits that can be placed in electrical contact with the plug 59, 61 and receptacle contacts 84, 86 and the solder balls 29 which surround them.

FIG. 24A is a schematic diagram of the arrangement of the signal and ground contacts in the first preferred embodiment. The signal and ground contacts are oriented in what is referred to as an "in-line stripline" configuration. In this configuration, there are individual ground contacts 59, 84 on either side of each signal contact 61, 86, which can also be understood with reference to FIGS. 3 and 19. As will be appreciated from FIGS. 3 and 19, individual ground contacts 59, 84 are disposed on either side of the signal contacts 61, 86 to provide an electrical ground reference for the signal contacts and to provide the electrical stripline configuration. The mating of the signal and ground contacts of the plug and receptacle assemblies is also shown in contacts, including the gap H, the thickness t, the width w and pitch p, can be varied to achieve the desired connector impedance and electrical performance.

Although this invention is not limited to such in-line stripline configurations, the in-line stripline configuration has several advantages (relative to the I-Beam approach described below that uses grounding plates on either side of a row of signal contacts) including advantages in terms of costs and manufacturing. For example, the same contact can be used in all locations, and the contacts can be continuously stamped, which produces relatively consistent contact gaps (H). This is beneficial in achieving the desired optimum electrical performance. Additionally, all connector contacts can be used for either differential or single ended signals or any combination of these. Molding of the carrier 104 shown in FIG. 24 is also easier because the contacts can be molded in a vertical row with contacts oriented so that the thin width is in the direction of mold closing. Another advantage is that because ground planes are not used, the connector mass (including its thermal mass) is lower which results in easier application to customers' printed circuit boards (POB).

FIG. 24B depicts a mezzanine in line stripline configuration in which the signal contacts are surrounded by ground contacts. This configuration is advantageous in reducing cross-talk.

Alternative Embodiment

Numerous variations of the plug assembly and the receptacle assembly set forth above can be made without departing from the spirit of the inventions set forth herein. Examples of such variations include but are not limited to ways to connect the plug and receptacle assemblies and their components, the arrangement of contacts within the assemblies, the configuration of the contact assemblies, the support for the contacts, and the shape and size of the assemblies.

Figure 25:
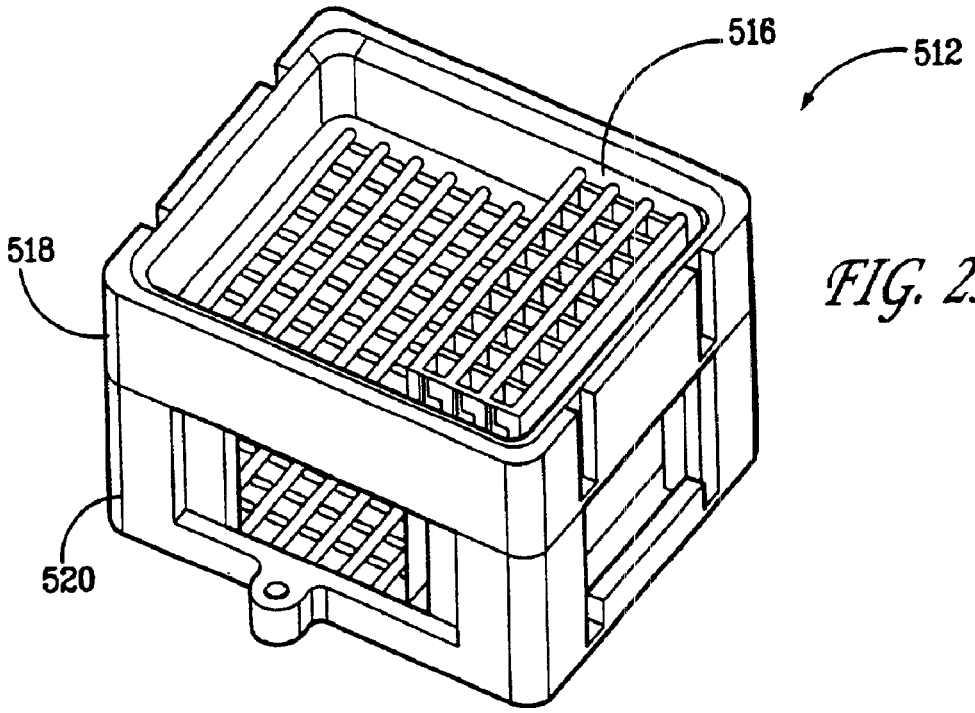
FIG. 25 is a perspective view of a portion of a second preferred embodiment of a plug assembly.
Figure 26:
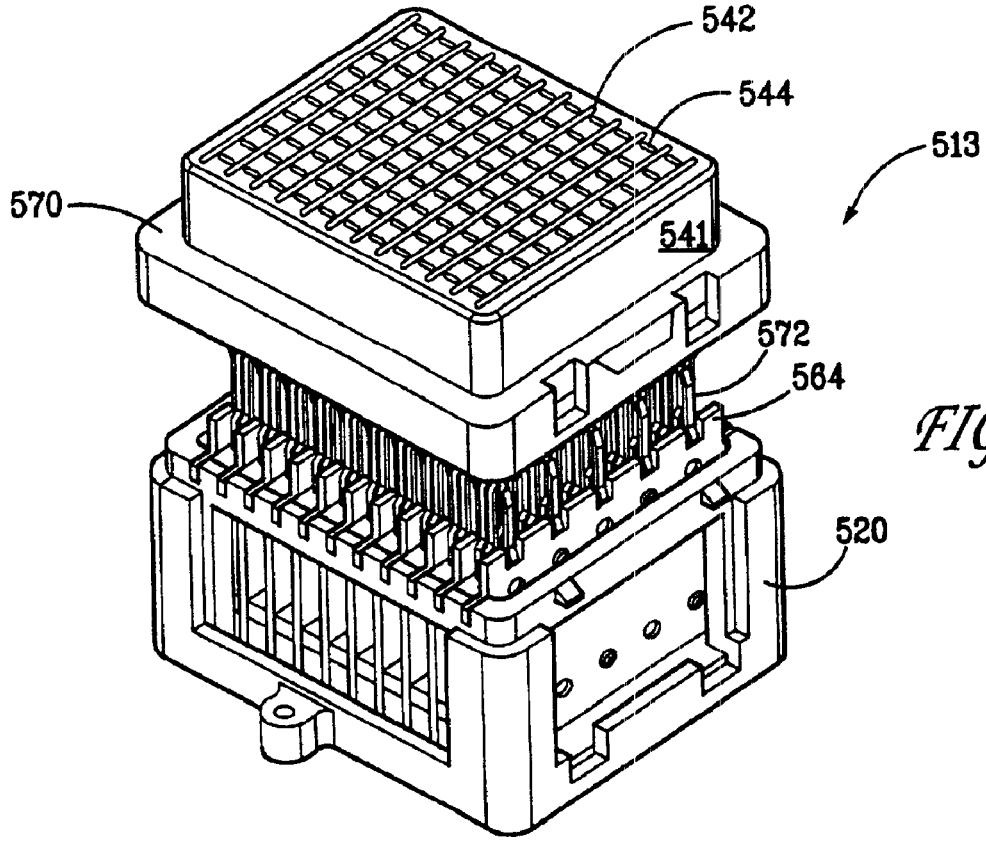
FIG. 26 is a perspective view of a portion of a second preferred embodiment of a receptacle assembly.

One alternative embodiment is set forth in FIGS. 25–30. FIG. 25 depicts an embodiment of plug cover 518 attached to a spacer 520 which can be used to form a plug assembly 512. A plurality of plug contact assemblies are installed within the plug cover 518 and the spacer 520. (Although only a few plug contact assemblies 516 are installed, it will be appreciated that the assembly could be filled with plug contact assemblies 516). FIG. 26 illustrates a receptacle cover 570 detached from a spacer 520 and a plurality of receptacle contact assemblies 572 installed within the spacer 520. The receptacle cover 570 and the plug cover 518 can be snap fit to the spacer 520. Although FIGS. 25 and 26 depict spacers 520 being used in the plug and receptacle assemblies, it will be understood that either assembly could be made with or without a spacer 520. Spacers 520 are used if the contact height dictates their use.

Figure 28:
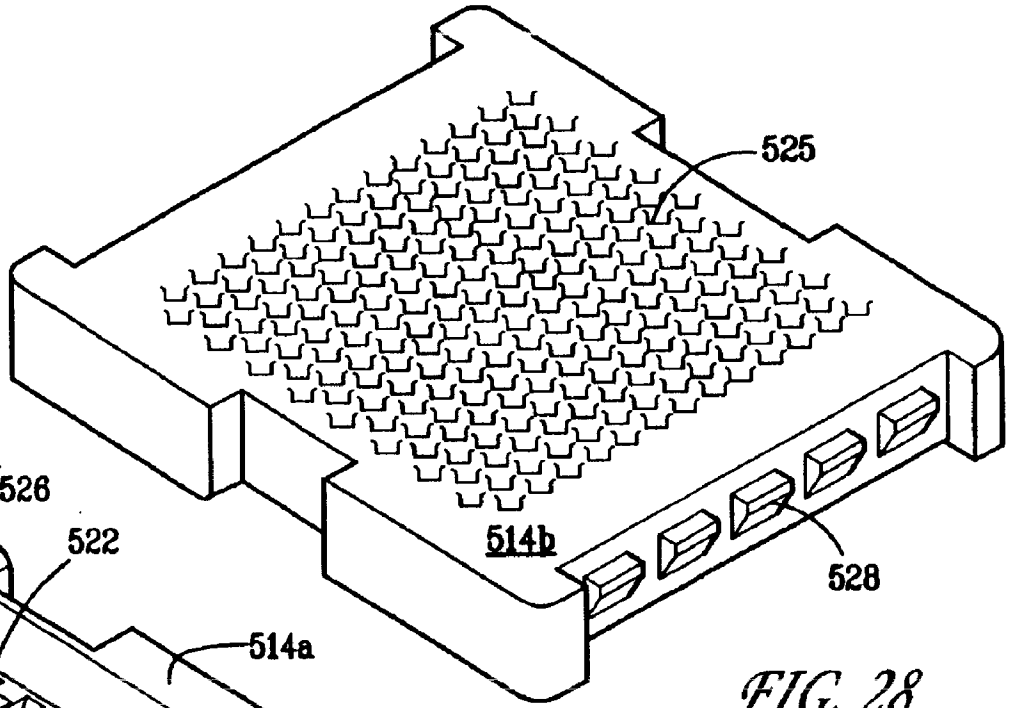
FIG. 28 is a perspective bottom view of a second preferred embodiment of a common base for the plug and receptacle assemblies of FIGS. 25 and 26.
Figure 27:
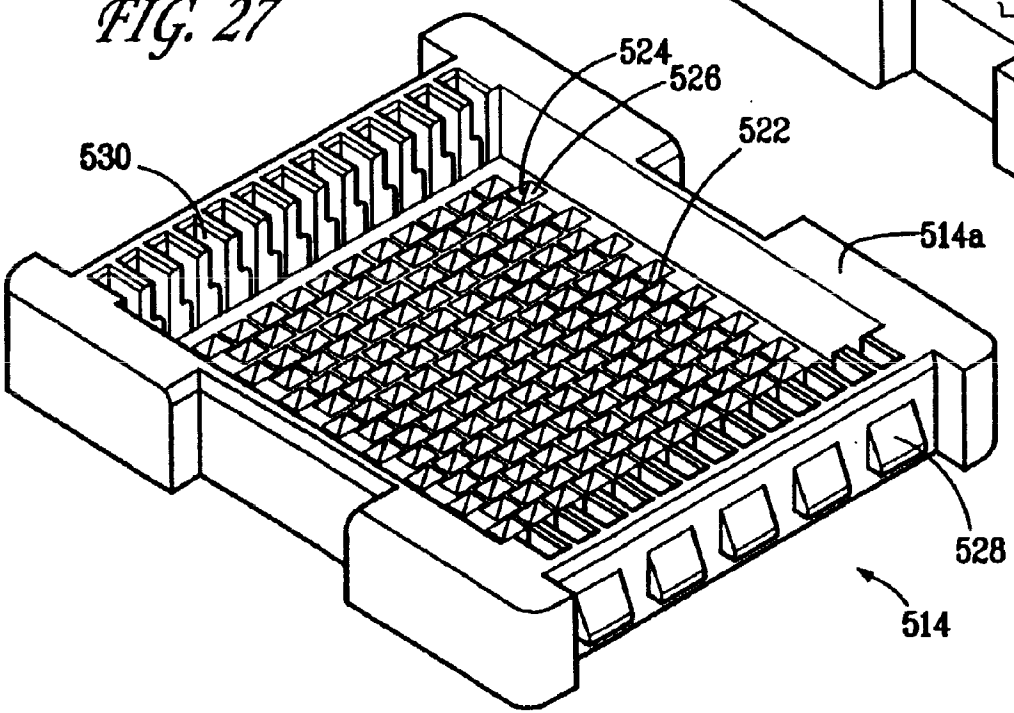
FIG. 27 is a perspective top view of a second preferred embodiment of a common base for the plug and receptacle assemblies of FIGS. 25 and 26.

FIGS. 27 and 28 respectively illustrate a top and bottom perspective view of an embodiment of a common base 514 that can be used with both the plug assembly shown in FIG. 25 and the receptacle assembly shown in FIG. 26. The common base 514 can attach to the spacer 520 used in either assembly. In this embodiment, the tabs 528 of the base 514 are snap fit to channels (not shown) in the spacers 520.

The common base 514 has slots 530 for receiving either a plug or a receptacle contact assembly 516, 572. As shown in FIG. 27, which is a top view of the base 514, recesses 522 are disposed in the top 514*a* of the base 514 similar to those described in the first embodiment. A pair of opposing angled walls 524, 526 create each recess 522 and narrow the recess 522 to facilitate the insertion of a contact end through the recess 522. Diamond shaped pockets 525 are disposed on the bottom 514*b* of the base 514 beneath each recess 522. The diamond shaped pockets 525 are configured as in the first embodiment, so that the end of the contact extending through the recess 522 will have clearance to receive solder 529 around its periphery.

Figure 29:
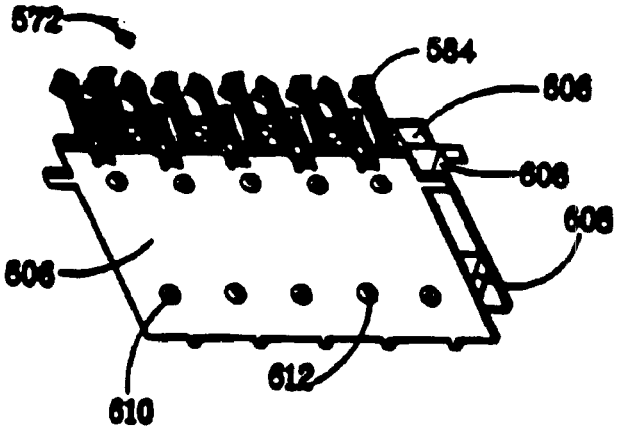
FIG. 29 is a perspective view of a second preferred embodiment of a receptacle contact assembly.
Figure 30:
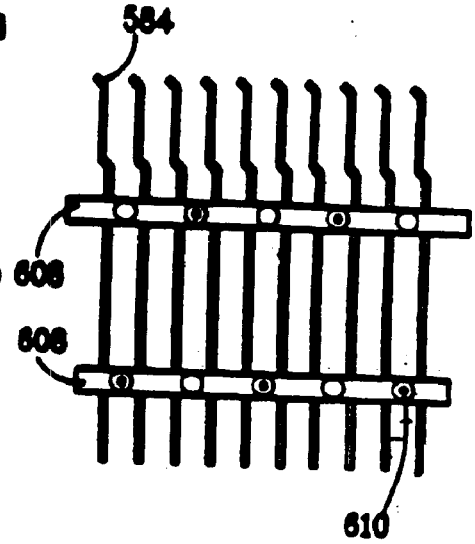
FIG. 30 is a side view of a portion of the receptacle contact assembly of FIG. 29.

FIGS. 29 and 30 depict an embodiment of a receptacle contact assembly 572. The receptacle contact assembly 572 has a plurality of receptacle contacts 584, a pair of ground plates 606 and a pair of plastic carriers 608. The receptacle contacts can be formed by stamping and then being molded to the plastic carriers 608. The plastic carriers 608 may have protrusions 610 extending laterally for insertion into a corresponding hole 612 in a ground plate 606, as shown in FIG. 29.

Although FIGS. 29 and 30 depict a receptacle contact assembly 572, it will be appreciated that plug type contacts could be substituted for the receptacle contacts and the plug contact assembly 516 would otherwise be the same as that depicted in FIGS. 29 and 30. The contact assemblies 516, 572 are mounted within the plug 512 and the receptacle 513 by fitting either end of the ground plates 606 of the contact assembly 516, 572 in the slots 530 of the base 514 and the grooves (not shown) of the spacer 520. This is best understood with reference to FIG. 26.

The plug and the receptacle of this second embodiment can be mated together by inserting the receptacle cover 570 into the interior of the plug cover 518. It will be appreciated that the receptacle and plug covers 518, 570 are sized and shaped so as to from a relatively snug slide fit. When mated, the plug contacts extend through the slots in the receptacle covers to create electrical connections between the contacts.

Figure 32:
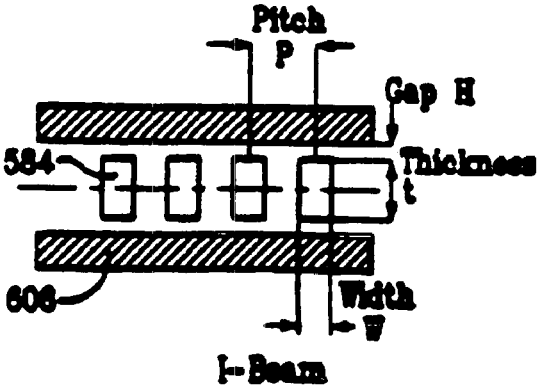
FIG. 32 is a schematic diagram of a preferred ground plane and signal contact configuration for the second preferred embodiment.

FIG. 32 is a schematic description of the configuration of the contacts in the second embodiment. This arrangement is referred to as an I-Beam configuration with grounding plates. In this configuration ground plates 606 provide the electrical ground reference for the signal contacts. This is in contrast to the in line stripline approach described above which uses individual ground contacts. The geometric relationship including the pitch p, the thickness t, and the gap h, and the width w can be controlled to obtain the desired connector impedance and electrical performance. Although the in-line stripline configuration has some advantages, which are noted above, it will be understood, that either the in-line stripline or I-Beam configuration with grounding plates can be used to obtain the desired electrical performance.

Figure 31:
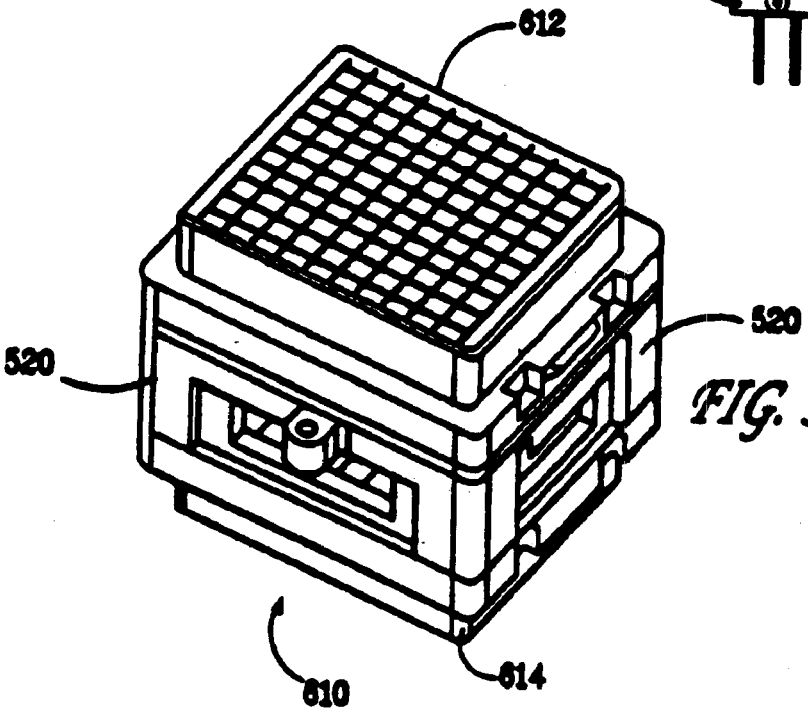
FIG. 31 is a perspective view of a preferred embodiment of an adapter.

An adaptor can be used with various combinations of plugs and receptacles. For example, FIG. 31 depicts an embodiment of an adaptor 610 that can be used to form a plug to adaptor to plug assembly. The adaptor 610 can be manufactured from plastic or any suitable material. The adapter 610 is constructed so as to mate with two plugs 512 when longer connections are needed than just the plug 512 to the receptacle 513. The adapter 610 can be attached at one of its ends 612 to the plug 512 and at the other end 614 to another plug 512. The adapter 610 can be constructed from a receptacle cover 570 at either end for mating with a plug assembly 512. The adaptor 610 can also have none or one or more spacers 520 depending upon the length of the connection needed. A plurality of contacts can be installed within the adapter that have ends for mating with plug contacts. Although the embodiment adapter 610 shown is for use with the second embodiment, it will be appreciated that the adapter 610 can have other embodiments including one for mating with the first embodiment shown. Although a plug to plug adaptor 610 has been described, it will be appreciated that a receptacle to receptacle adaptor could be formed, as well as various other combinations of plug and receptacle adaptors.

SUMMARY

By using the plug 12, the receptacle 13, the spacers 20 and the adapter 110, if needed a modular connector assembly can be formed that accommodates a selected stack height. After selecting a stack height, the proper contact height and contact assembly for both the plug 12 and the receptacle 13 can be selected. The plug and the receptacle contact assemblies 16, 72 of the selected stack height can be inserted into and coupled to the base 14 of the respective plug 12 and the receptacle 13. If needed for the stack height, one or more spacers 20 can be connected to either or both the receptacle base 14 and the plug base 14. For the plug, the plug cover 18 can then be coupled to the base 14. Alternatively, for larger stack heights one or more spacers 20 can be attached to the plug base 14, and the plug cover 18 can be mounted to the top spacer 20. For the receptacle 13 a receptacle cover 70 can be coupled to the base 14. Similarly, for larger stack heights one or more spacers 20 can be attached to the receptacle base 14, and the receptacle cover 70 can then be attached to the top most spacer 20. Then the plug 12 and the receptacle 13 can be mated by attaching the plug cover 18 to the receptacle cover 70. If needed, based on the length of the connection, an adaptor 110 can be attached to the receptacle 13 and the plug 12 or to two plugs or two receptacles instead of attaching the receptacle directly to the plug 12. The plug base 14 can then be attached to a board or other electrical component, and the receptacle base 13 can likewise be attached to a board or another electrical component.

With the base 14, the spacers 20, covers 18, 70 and adapters 110 a modular connector can be constructed to accommodate a selected stack height. The modular connector need only include those components needed for the given stack height. This is advantageous because a modular connector can be built with the given components to any desired stack height. A new type of connector need not be designed for each stack height. This simplifies the manufacturing process because a variety of components can be manufactured to make a variety of connectors instead of dedicated components for connectors of different heights. For example, a common base 14 is used for both the plug and the receptacle assemblies 12, 13. Moreover, an adapter 110 can be used with common components including a receptacle cover and a plug cover, and each assembly can use a common spacer.

Although this invention has a variety of applications, one such application is in connectors having a stack height between the range of about 10–35mm. and contact quality of about 100 to 400 signal contacts per connector. One advantage of the connectors of this invention is the interstitial diamond pattern of pockets 25 in the base 14. This provides for closely packing the contacts to maintain the size of the connector relatively small while maintaining a good signal and low cross talk. The diamond shape pockets 25 also ensure good contact wetting or solder attached around the entire periphery of the contact ends. This as described above ensures good electrical performance.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A modular mezzanine connector system, comprising:

(a) a plug assembly, comprising:

($a_1$) a first common base comprising a plurality of fusible elements which are each disposed adjacent to the first common base;

($a_2$) a plug contact assembly mounted within the plug assembly comprising a plurality of plug contacts, each plug contact comprising an end which is secured to one of the fusible elements adjacent to the first common base;

($a_3$) a plug cover coupled to the first common base; and ($a_4$) a spacer mounted between the plug cover and the first common base; and (b) a receptacle assembly that mates with the plug assembly, comprising:

($b_1$) a second common base comprising a plurality of fusible elements which are each disposed adjacent to the second common base and wherein the first common base and the second common base are substantially identical and interchangeable;

($b_2$) a receptacle contact assembly mounted within the receptacle assembly and comprising a plurality of receptacle contacts, each receptacle contact comprising an end which is secured to one of the fusible elements adjacent to the second common base; and ($b_3$) a receptacle cover that is coupled to the second common base and that mates with the plug cover.

2. The modular mezzanine connector system of claim 1, wherein the receptacle assembly further comprises a spacer mounted between the receptacle cover and the second common base.

3. The modular mezzanine connector system of claim 1, wherein the plug assembly further comprises a spacer mounted between the plug cover and the first common base and the receptacle assembly further comprises a spacer mounted between the receptacle cover and the second common base.

4. The modular mezzanine connector system of claim 1, wherein the plurality of plug and receptacle contacts are disposed in an in-line stripline configuration.

5. The modular mezzanine connector system of claim 1, wherein the plurality of plug contacts and receptacle contacts comprise signal contacts and are disposed in a row each contact oriented perpendicular to a ground plane.

6. The modular mezzanine connector system of claim 1, further comprising an adaptor which is mated to the plug cover and the receptacle cover.

7. The modular mezzanine style connector of claim 1, wherein the receptacle contact assembly further comprises a support member and the receptacle cover further comprises a member that runs along a midplane through the receptacle cover, the member of the receptacle cover having a groove so that the support member is inserted into the groove in order to center align the receptacle contact assembly.

8. The modular mezzanine connector system of claim 1, wherein the receptacle contact assembly comprises at least one row of individual contacts that are disposed in a ground, signal, signal, ground pattern, and wherein the plug contact assembly comprises at least one row of individual contacts disposed in a ground, signal, ground pattern, and wherein each adjacent two receptacle signal contacts mate with one plug signal contact beam.

9. The modular mezzanine connector system of claim 1, wherein the plurality of plug contacts and receptacle contacts comprise rows of signal and ground contacts disposed within a pattern in each pattern.

10. The modular mezzanine connector system of claim 9, wherein each plug ground contact comprises a first lateral side and a second lateral side and wherein the receptacle ground contacts within a row alternate mating with the first lateral side and the second lateral side of a ground plug contact.

11. The modular mezzanine connector system of claim 1, wherein the plurality of fusible elements of the first common base are each disposed within respective pockets defined within the first common base, and the plurality of fusible elements of the second common base are each disposed within respective pockets defined within the second common base.

12. The modular mezzanine connector system of claim 11, wherein the pockets of the first and the second common base are disposed in an interstitial diamond configuration.

13. The modular mezzanine connector system of claim 11, wherein the pockets of the first and the second common base are disposed in an interstitial diamond configuration and the first and the second common base further comprise a recess disposed above each of the pockets through which a contact can be inserted.

14. A method of making a modular mezzanine connector system to a desired stack height, comprising:

inserting a plurality of plug contacts into a first common base;

coupling a plug cover to the first common base and if needed to meet the desired stack height attaching a spacer between the plug base and the plug cover;

inserting a plurality of receptacle contacts into a second common base interchangeable with the first common base, the first and the second common bases each comprising a plurality of pockets that are disposed in an interstitial diamond configuration;

coupling a receptacle cover to the second common base; and coupling the plug cover to the receptacle cover and thereby placing the plurality of plug contacts into electrical communication with the plurality of receptacle contacts.

15. The method of claim 14, wherein each of the fusible elements comprise a solder ball.

16. The method of claim 14, wherein inserting the plurality of plug contacts further comprises inserting the plurality of plug contacts in an in-line stripline configuration and wherein inserting the plurality of receptacle contacts further comprises inserting the receptacle contacts in an in-line stripline configuration.

17. The method of claim 14, wherein inserting the plurality of plug contacts further comprises inserting the plurality of plug contacts in a row with each contact oriented perpendicular to a ground plane and wherein inserting the plurality of receptacle contacts further comprises inserting the receptacle contacts in a row perpendicular to a ground plane.

18. The method of claim 14, wherein coupling the plug cover to the first common base comprises inserting a plurality of tabs extending from the first common base into a plurality of channels in the plug cover.

19. The method of claim 14, wherein coupling the receptacle cover to the second common base comprises inserting a plurality of tabs extending from the second common base into a plurality of channels in the receptacle cover.

20. The method of claim 14, wherein coupling the plug cover to the receptacle cover comprises inserting the receptacle cover into an interior of the plug cover in an interference fit.

21. The method of claim 14, wherein coupling the plug cover to the receptacle cover comprises inserting the plurality of plug contacts through slots in the receptacle cover and into contact with a corresponding receptacle contact.

22. The method of claim 14, wherein coupling the plug cover to the receptacle cover and thereby placing the plurality of plug contacts into electrical communication with the plurality of receptacle contacts comprises mating each ground receptacle contact in an alternating pattern with each plug ground contact such that every other receptacle ground contact within a row of receptacle contacts mates with a first lateral side of a plug ground contact and the other receptacle contacts with the row of receptacle contacts mate with a second lateral side of a plug ground contact.

23. The method of claim 14, further comprising inserting a support member of the receptacle contact assembly into a groove of a member that extends along a midplane of the receptacle cover to thereby center align the receptacle contacts.

24. A modular mezzanine connector system, comprising:

a plug assembly and a receptacle assembly that mates with the plug assembly, the plug assembly and the receptacle assembly each comprising a base which comprises a plurality of recesses;

a plurality of diamond pockets disposed in an interstitial diamond configuration and there being a pocket beneath each recess so that a contact can extend through one of the recesses and into one of the pockets;

the plurality of recesses being substantially rectangular in shape so that a contact extending through the recess and into the diamond pocket can receive a fusible element around a periphery of a portion of the contact extending into the pocket.

25. The modular mezzanine connector system of claim 24, further comprising a plug cover coupled to the base of the plug assembly and a receptacle cover coupled to the base of the receptacle assembly.

26. The modular mezzanine connector system of claim 24, wherein the plug assembly further comprises a plurality of plug contacts disposed in an in-line stripline configuration and the receptacle assembly further comprises a plurality of receptacle contacts disposed in an in-line stripline configuration.

27. The modular mezzanine connector system of claim 24, wherein the plug assembly further comprises a plurality of plug contacts disposed in a row with each contact oriented perpendicular to a ground plane and the receptacle assembly further comprises a plurality of receptacle contacts disposed in a row parallel to a ground plane.

28. The modular mezzanine style connector of claim 24, wherein the receptacle assembly further comprises a receptacle cover having a member that extends along a midplane of the receptacle assembly and that has a plurality of grooves that receive a support member of a contact assembly in order to center align each contact assembly.

29. The modular mezzanine style connector of claim 24, wherein the receptacle assembly further comprises a receptacle contact assembly comprising at least one row of individual contacts that are disposed in a ground, signal, signal, ground pattern, and wherein the plug assembly further comprises a plug contact assembly comprising at least one row of individual contacts disposed in a ground, signal, ground pattern, and wherein each adjacent two receptacle signal contacts mate with one plug signal contact.

30. An electrical connector system, comprising:

(a) a plug assembly, comprising:

(a1) a first common base comprising a plurality of fusible elements which are each disposed adjacent to the first common base;

(a2) a plug contact assembly mounted within the plug assembly comprising a plurality of individual ground and signal plug contacts, each plug contact comprising an end which is secured to one of the fusible elements adjacent to the first common base;

(a3) a plug cover coupled to the first common base;

(b) a receptacle assembly that mates with the plug assembly, comprising:

(b1) a second common base comprising a plurality of fusible elements which are each disposed adjacent to the second common base and wherein the first common base and the second common base are substantially identical and interchangeable;

(b2) a receptacle contact assembly mounted within the receptacle assembly comprising a plurality of individual ground and signal receptacle contacts, each receptacle contact comprising an end which is secured to one of the fusible elements adjacent to the second common base, the individual ground and signal receptacle contacts being disposed in rows with each row having contact beams disposed in a ground, signal, signal, ground pattern, each receptacle signal contact mating one of the individual plug signal contacts and each receptacle ground contact mating one of the individual plug ground contacts;

(b3) a receptacle cover that is coupled to the second common base and that mates with the plug cover.

31. The system of claim 30, wherein the plurality of fusible elements of the first common base are each disposed within respective pockets defined within the first common base, and the plurality of fusible elements of the second common base are each disposed within respective pockets defined within the second common base.

32. A modular mezzanine connector system, comprising:

(a) a plug assembly, comprising:

($a_1$) a first common base comprising a plurality of fusible elements which are each disposed adjacent to the first common base;

($a_2$) a plug contact assembly mounted within the plug assembly comprising a plurality of plug contacts, each plug contact comprising an end which is secured to one of the fusible elements adjacent to the first common base; and ($a_3$) a plug cover coupled to the first common base; and (b) a receptacle assembly that mates with the plug assembly, comprising:

($b_1$) a second common base comprising a plurality of fusible elements which are each disposed adjacent to the second common base and wherein the first common base and the second common base are substantially identical and interchangeable;

($b_2$) a receptacle contact assembly mounted within the receptacle assembly and comprising a plurality of receptacle contacts, each receptacle contact comprising an end which is secured to one of the fusible elements adjacent to the second common base;

($b_3$) a receptacle cover that is coupled to the second common base and that mates with the plug cover; and ($b_4$) a spacer mounted between the receptacle cover and the second common base.

33. The system of claim 32, wherein the plurality of fusible elements of the first common base are each disposed within respective pockets defined within the first common base, and the plurality of fusible elements of the second common base are each disposed within respective pockets defined within the second common base.

34. A modular mezzanine connector system, comprising:

(a) a plug assembly, comprising:

($a_1$) a first common base comprising a plurality of fusible elements which are each disposed adjacent to the first common base;

($a_2$) a plug contact assembly mounted within the plug assembly comprising a plurality of plug contacts, each plug contact comprising an end which is secured to one of the fusible elements adjacent to the first common base;

($a_3$) a plug cover coupled to the first common base; and ($a_4$) a spacer mounted between the plug cover and the first common base; and (b) a receptacle assembly that mates with the plug assembly, comprising:

($b_1$) a second common base comprising a plurality of fusible elements which are each disposed adjacent to the second common base and wherein the first common base and the second common base are substantially identical and interchangeable;

($b_2$) a receptacle contact assembly mounted within the receptacle assembly and comprising a plurality of receptacle contacts, each receptacle contact comprising an end which is secured to one of the fusible elements adjacent to the second common base; and ($b_3$) a receptacle cover that is coupled to the second common base and that mates with the plug cover, and ($b_4$) a spacer mounted between the receptacle cover and the second common base.

35. The system of claim 34, wherein the plurality of fusible elements of the first common base are each disposed within respective pockets defined within the first common base, and the plurality of fusible elements of the second common base are each disposed within respective pockets defined within the second common base.

36. A modular mezzanine connector system, comprising:

(a) a plug assembly, comprising:

($a_1$) a first common base comprising a plurality of fusible elements which are each disposed within a pocket defined within the first common base;

($a_2$) a plug contact assembly mounted within the plug assembly comprising a plurality of plug contacts, each plug contact comprising an end which is secured to one of the fusible elements within one of the pockets of the first common base; and ($a_3$) a plug cover coupled to the first common base; and (b) a receptacle assembly that mates with the plug assembly, comprising:

($b_1$) a second common base comprising a plurality of fusible elements which are each disposed within a pocket disposed within the second common base and wherein the first common base and the second common base are substantially identical and interchangeable;

($b_2$) a receptacle contact assembly mounted within the receptacle assembly and comprising a plurality of receptacle contacts, each receptacle contact comprising an end which is secured to one of the fusible elements within one of the pockets of the second common base; and ($b_3$) a receptacle cover that is coupled to the second common base and that mates with the plug cover, wherein the pockets of the first and the second common bases are disposed in an interstitial diamond configuration.

37. A modular mezzanine connector system, comprising:

(a) a plug assembly, comprising:

($a_1$) a first common base comprising a plurality of fusible elements which are each disposed within a pocket defined within the first common base;

($a_2$) a plug contact assembly mounted within the plug assembly comprising a plurality of plug contacts, each plug contact comprising an end which is secured to one of the fusible elements within one of the pockets of the first common base; and ($a_3$) a plug cover coupled to the first common base; and (b) a receptacle assembly that mates with the plug assembly, comprising:

($b_1$) a second common base comprising a plurality of fusible elements which are each disposed within a pocket disposed within the second common base and wherein the first common base and the second common base are substantially identical and interchangeable;

($b_2$) a receptacle contact assembly mounted within the receptacle assembly and comprising a plurality of receptacle contacts, each receptacle contact comprising an end which is secured to one of the fusible elements within one of the pockets of the second common base; and ($b_3$) a receptacle cover that is coupled to the second common base and that mates with the plug cover, wherein the pockets of the first and the second common bases are disposed in an interstitial diamond configuration and the first and second common bases further comprise a recess disposed above each of the pockets through which a contact can be inserted.

38. A modular mezzanine connector system, comprising:

(a) a plug assembly, comprising:

($a_1$) a first common base comprising a plurality of fusible elements which are each disposed adjacent to the first common base;

($a_2$) a plug contact assembly mounted within the plug assembly comprising a plurality of plug contacts, each plug contact comprising an end which is secured to one of the fusible elements adjacent to the first common base; and ($a_3$) a plug cover coupled to the first common base; and (b) a receptacle assembly that mates with the plug assembly, comprising:

($b_1$) a second common base comprising a plurality of fusible elements which are each disposed adjacent to the second common base and wherein the first common base and the second common base are substantially identical and interchangeable;

($b_2$) a receptacle contact assembly mounted within the receptacle assembly and comprising a plurality of receptacle contacts and a support member, each receptacle contact comprising an end which is secured to one of the fusible elements adjacent to the second common base, the receptacle assembly further comprising a support member;

($b_3$) a receptacle cover that is coupled to the second common base and that mates with the plug cover, the receptacle cover comprising a member that runs along a midplane through the receptacle cover, the member of the receptacle cover having a groove so that the support member is inserted into the groove in order to center align the receptacle contact assembly.

39. The system of claim 38, wherein the plurality of fusible elements of the first common base are each disposed within respective pockets defined within the first common base, and the plurality of fusible elements of the second common base are each disposed within respective pockets defined within the second common base.

40. A modular mezzanine connector system, comprising:

(a) a plug assembly, comprising:

($a_1$) a first common base comprising a plurality of fusible elements which are each disposed adjacent to the first common base;

($a_2$) a plug contact assembly mounted within the plug assembly comprising a plurality of plug contacts, each plug contact comprising an end which is secured to one of the fusible elements adjacent to the first common base, the plug contact assembly comprising at least one row of individual contacts disposed in a ground, signal, ground pattern; and ($a_3$) a plug cover coupled to the first common base; and (b) a receptacle assembly that mates with the plug assembly, comprising:

($b_1$) a second common base comprising a plurality of fusible elements which are each disposed adjacent to the second common base and wherein the first common base and the second common base are substantially identical and interchangeable;

($b_2$) a receptacle contact assembly mounted within the receptacle assembly and comprising a plurality of receptacle contacts, each receptacle contact comprising an end which is secured to one of the fusible elements adjacent to the second common base, the receptacle contact assembly comprising at least one row of individual contacts that are disposed in the ground, signal, signal, ground pattern, each adjacent two receptacle signal contacts mating with one plug signal contact beam; and ($b_3$) a receptacle cover that is coupled to the second common base and that mates with the plug cover.

41. The system of claim 40, wherein the plurality of fusible elements of the first common base are each disposed within respective pockets defined within the first common base, and the plurality of fusible elements of the second common base are each disposed within respective pockets defined within the second common base.

42. A method of making a modular mezzanine connector system to a desired stack height, comprising:

inserting a plurality of plug contacts into a first common base;

coupling a plug cover to the first common base and if needed to meet the desired stack height attaching a spacer between the plug base and the plug cover;

inserting a plurality of receptacle contacts into a second common base interchangeable with the first common base;

coupling a receptacle cover to the second common base;

coupling the plug cover to the receptacle cover and thereby placing the plurality of plug contacts into electrical communication with the plurality of receptacle contacts; and inserting a support member of the receptacle contact assembly into a groove of a member that extends along a midplane of the receptacle cover to thereby center align the receptacle contacts.

* * * * *